US010696532B1

(12) United States Patent
Steele et al.

(10) Patent No.: US 10,696,532 B1
(45) Date of Patent: Jun. 30, 2020

(54) PORTABLE HYDRATION SYSTEM

(71) Applicant: Arapaho Technologies Inc., Boulder, CO (US)

(72) Inventors: Matthew J. Steele, Boulder, CO (US); Mark S. Soderberg, Conifer, CO (US)

(73) Assignee: ARAPAHO TECHNOLOGIES INC., Boulder, CO (US)

( * ) Notice: Subject to any disclaimer, the term of this patent is extended or adjusted under 35 U.S.C. 154(b) by 0 days.

(21) Appl. No.: 16/537,300

(22) Filed: Aug. 9, 2019

Related U.S. Application Data

(63) Continuation of application No. 16/416,131, filed on May 17, 2019, now Pat. No. 10,421,655.

(51) Int. Cl.

| | |
|---|---|
| ***A45F 3/20*** | (2006.01) |
| ***B67D 1/12*** | (2006.01) |
| ***A45F 3/16*** | (2006.01) |
| *B67D 1/08* | (2006.01) |
| *A62B 18/08* | (2006.01) |
| *B67D 1/00* | (2006.01) |
| *B67D 1/10* | (2006.01) |

(52) U.S. Cl.
CPC ..... *B67D 1/1243* (2013.01); *A45F 3/16* (2013.01); *A62B 18/086* (2013.01); *B67D 1/0005* (2013.01); *B67D 1/0888* (2013.01); *B67D 1/10* (2013.01); *B67D 2001/0097* (2013.01); *B67D 2210/00131* (2013.01)

(58) Field of Classification Search
CPC ..... B67D 1/1243; B67D 1/10; B67D 2210/00131; B67D 1/0888; B67D 1/0005; B67D 2001/0097; A45F 3/16; A62B 18/086
See application file for complete search history.

(56) References Cited

U.S. PATENT DOCUMENTS

| | | | |
|---|---|---|---|
| 2,725,725 | A | 12/1955 | Vincent et al. |
| 2,969,064 | A | 1/1961 | Metz |
| 4,150,681 | A | 4/1979 | Howarth, Jr. |
| 4,526,298 | A | 7/1985 | Boxer et al. |
| 4,541,657 | A | 9/1985 | Smyth |
| 4,629,098 | A | 12/1986 | Eger |
| 4,815,635 | A | 3/1989 | Porter |
| 4,966,580 | A | 10/1990 | Turner et al. |
| 5,060,833 | A | 10/1991 | Edison et al. |
| 5,062,591 | A | 11/1991 | Runkel |
| 5,085,349 | A | 2/1992 | Fawcett |
| 5,128,212 | A | 7/1992 | Kneale et al. |
| 5,201,442 | A | 4/1993 | Bakalian |
| 5,265,769 | A | 11/1993 | Wilson |
| 5,316,041 | A | 5/1994 | Ramacier, Jr. et al. |
| 5,378,024 | A | 1/1995 | Kumagai et al. |
| 5,571,260 | A | 11/1996 | Krug |
| 5,607,087 | A | 3/1997 | Wery et al. |
| 5,645,404 | A | 7/1997 | Zelenak |
| 5,735,440 | A | 4/1998 | Regalbuto |
| 5,755,368 | A | 5/1998 | Bekkedahl |
| 5,921,445 | A | 7/1999 | Schmitz et al. |

(Continued)

*Primary Examiner* — David P Angwin
*Assistant Examiner* — Bob Zadeh
(74) *Attorney, Agent, or Firm* — Stephen Katsaros

(57) ABSTRACT

A portable hydration system and various components are disclosed. The system utilizes a pump to transfer potable liquid (e.g. water) from a liquid container to a user during challenging activities (e.g. endurance motorcycle riding).

12 Claims, 23 Drawing Sheets

(56) References Cited

U.S. PATENT DOCUMENTS 5,975,387 A 11/1999 Gleason et al.
6,039,305 A 3/2000 Hoskins et al.
6,062,435 A 5/2000 Hess
6,070,767 A 6/2000 Gardner et al.
6,105,827 A 8/2000 Rowan
6,283,344 B1 * 9/2001 Bradley ..... A42B 1/24 222/175
6,364,168 B1 4/2002 Gardner et al.
6,497,348 B2 12/2002 Forsman et al.
6,675,998 B2 1/2004 Forsman et al.
6,749,090 B2 6/2004 Bailey
6,755,047 B2 6/2004 Kreutzmann et al.
6,892,915 B2 5/2005 Mares
6,908,015 B2 6/2005 Choi et al.
6,981,613 B1 1/2006 Kamisugi
7,007,502 B2 3/2006 Kreutzmann et al.
7,032,837 B2 * 4/2006 Eddins ..... B05B 3/02 222/1
7,063,243 B2 6/2006 Forsman et al.
7,070,075 B2 7/2006 Forsman et al.
7,073,688 B2 7/2006 Choi et al.
7,141,043 B2 11/2006 Harvie
7,201,299 B2 4/2007 Forsman
7,712,681 B2 5/2010 Fulkerson et al.
7,806,300 B1 10/2010 Noell et al.
7,971,549 B2 7/2011 Skillern et al.
8,083,105 B2 12/2011 Reichert et al.
8,220,664 B1 7/2012 Teetzel et al.
8,267,283 B2 9/2012 Staten
8,267,785 B2 9/2012 Yamashita et al.
8,371,832 B2 2/2013 Rotem et al.
8,408,425 B2 4/2013 Lien
8,460,234 B1 6/2013 Duron-Smith
8,469,226 B2 6/2013 Davies et al.
8,594,573 B2 11/2013 Miettinen et al.
8,893,984 B2 11/2014 Sands et al.
8,905,330 B2 12/2014 Paukovits et al.
8,961,461 B2 2/2015 Stewart et al.
D732,392 S 6/2015 Duran et al.
9,244,449 B2 1/2016 Tennyson et al.
9,253,168 B2 2/2016 Panther
9,342,996 B2 5/2016 King
9,375,742 B1 6/2016 Yoked
D768,940 S 10/2016 Steffens
9,624,083 B2 4/2017 Tuggle et al.
9,715,287 B2 7/2017 Park et al.
9,902,605 B2 2/2018 Lux et al.
10,046,228 B2 8/2018 Tran et al.
10,179,726 B2 1/2019 Steele
10,231,567 B2 3/2019 Perrelli et al.
10,421,655 B1 * 9/2019 Steele ..... A45F 3/16
2001/0051788 A1 12/2001 Paukovits et al.
2004/0045980 A1 3/2004 Robins
2004/0055254 A1 3/2004 Setton
2004/0069008 A1 4/2004 Kreutzmann et al.
2006/0086821 A1 4/2006 Junkel et al.
2006/0180154 A1 8/2006 Stone
2007/0119866 A1 5/2007 Sheppard
2007/0213676 A1 * 9/2007 Popoalii ..... A61H 19/00 604/279
2008/0234600 A1 9/2008 Marsh
2009/0140005 A1 6/2009 Reichert et al.
2010/0044396 A1 2/2010 Skillern
2010/0101253 A1 4/2010 Searle
2013/0150823 A1 6/2013 Montgomery et al.
2016/0090981 A1 3/2016 Ryan
2016/0374021 A1 12/2016 Alpman et al.
2017/0081209 A1 3/2017 Robert
2017/0156540 A1 6/2017 Wheatley et al.
2017/0312960 A1 11/2017 Bertini et al.
2018/0035787 A1 * 2/2018 Jaeger ..... A42B 3/0406
2018/0035791 A1 2/2018 Jaeger et al.
2018/0193677 A1 * 7/2018 Jaeger ..... A42B 3/06
2019/0152760 A1 * 5/2019 Steele ..... A62B 18/086

* cited by examiner

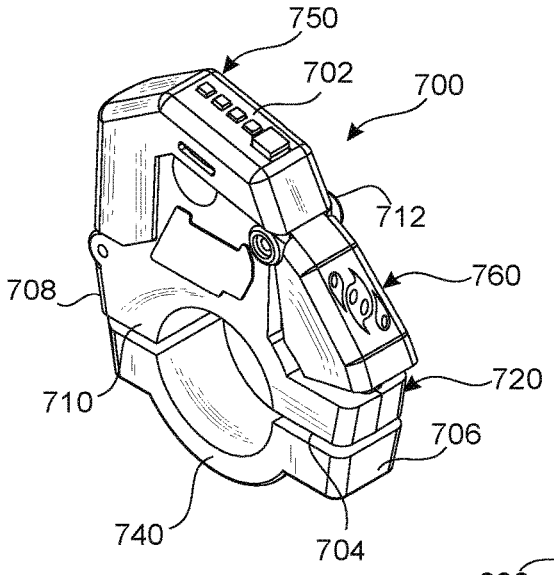
FIG. 37
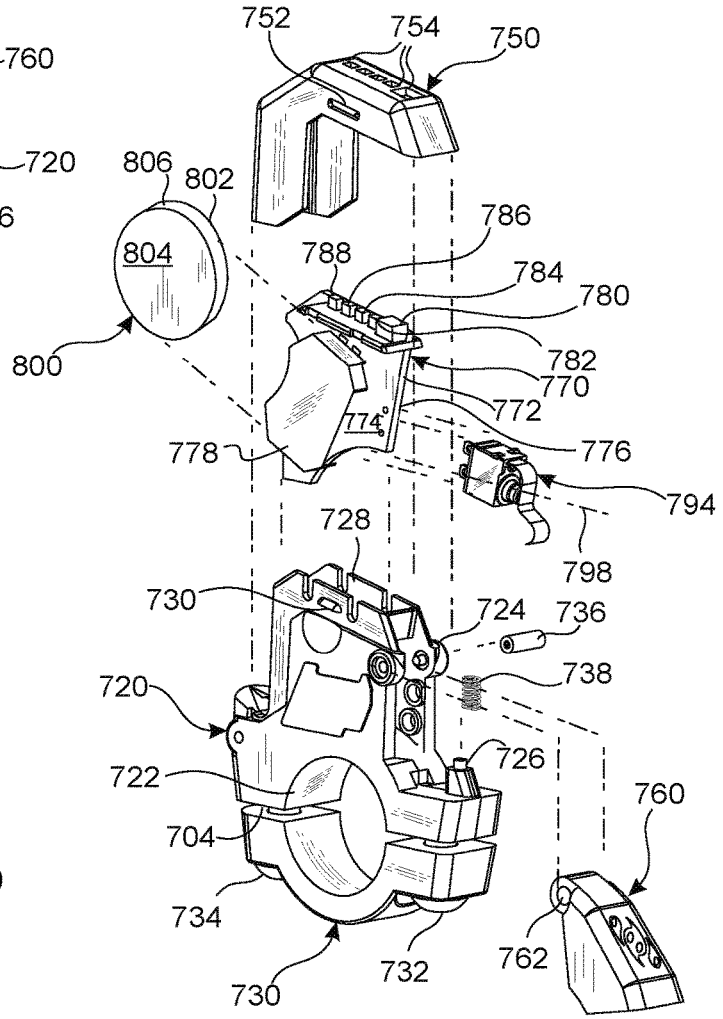
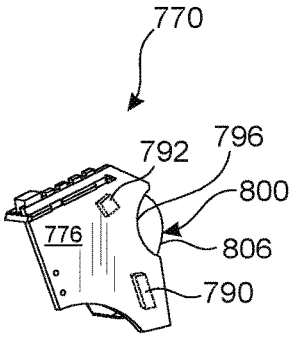
FIG. 39
FIG. 38

PORTABLE HYDRATION SYSTEM

CROSS REFERENCE TO RELATED APPLICATION

The present application claims priority to U.S. patent application Ser. No. 16/416,131 filed on May 17, 2019 titled "PORTABLE HYDRATION SYSTEM" by Matthew J. Steele et al.

TECHNICAL FIELD

This disclosure pertains generally, but not by way of limitation, to systems and methods for hydrating humans. In particular, the systems and methods described herein provide remote-controlled hydration.

BACKGROUND

Portable hydration is required to support life. Early versions of portable hydration systems included ceramic jugs, bottles, and backpacks with suction-operated hoses. These portable hydration devices have been sufficient for most, but not all, activities. During extreme activity, the user's attention and their hands are occupied; therefore, hydration is difficult to achieve and sometimes delayed even though needed.

SUMMARY

Humans need portable hydration to stay hydrated while working, recreating, and competing (e.g. while riding a motorcycle). For example, motorcyclist's focus is normally on the road ahead while both the hands are on the handlebars. Because the hands actively control the motorcycle, it is useful to locate an actuator that invokes hydration on the handlebars. Therefore, the system utilizes wireless communication techniques to (directly or indirectly) invoke a pump for transferring water from a liquid container to the user's mouth. However, a communication and a flow-path for this illustrative example brings a number of challenges.

To address these difficulties, the disclosed portable hydration system and methods are created. Specifically, the portable hydration system includes wirelessly communicating modules that communicate between components of the portable hydration system. In one example, a wirelessly communicating module is located on a back of a user assisting with communication to their front (in one specific example, the hands operating a handlebar). By properly orienting a pump antenna to a position where signals may travel unobstructed to/from an actuator antenna, the portable hydration system achieves reliable communication to a second module on the handlebar. In addition, the pump is primed with liquid to deliver it quickly; in-part through a hose connector capable of managing harsh environmental condition while still functioning properly for a long period of time. Additionally, hose routing and nozzle-aiming improvements are created so that the system works reliably in harsh environmental conditions.

One general aspect of a portable hydration system may include: a liquid container operably attached to a user, the liquid container may include: a liquid outlet; a pump assembly in fluid communication with the liquid container, the pump assembly may include: a pump; a fluid inlet in fluid communication with the liquid container and the pump; an electronics package in electrical communication with the pump, the electronics package may include: a pump transceiver operable to wirelessly communicate; and a pump power supply in electrical communication with the pump and the electronics package; an actuator operable to initiate liquid flow, the actuator may include: an actuator transceiver operable to wirelessly communicate with the pump transceiver; an actuator antenna in electrical communication with the actuator transceiver; and an actuator power supply that is different than the pump power supply; a line-set may include: a hose defining a proximal end in fluid communication with the liquid outlet of the liquid container and an oppositely disposed distal end operable to deliver liquid to the mouth of the user; a cable defining a proximal end in electrical communication with the pump transceiver and an oppositely disposed distal end attached to the hose; and a pump antenna attached to the distal end of the cable and operable to wirelessly communicate with the actuator antenna.

Another general aspect of a method of hydrating a user may include: providing a liquid container operable to attach to the user; providing a pump assembly in fluid communication with the liquid container; the pump assembly may include: a pump; an electronics package in electrical communication with the pump; and a pump transceiver operable to communicate wirelessly; providing a line-set defining a proximal end attached to the pump assembly and an oppositely disposed distal end operable to deliver liquid to a mouth of the user; the line-set may include: a hose for conveying liquid from the liquid container to the user via the pump; a cable defining a proximal end attached to the pump transceiver and an oppositely disposed distal end; and a pump antenna attached to the distal end of the cable; providing an actuator operable to user-initiate liquid flow, the actuator may include: an actuator transceiver for wirelessly communicating with the electronics package via the pump transceiver; and an actuator antenna in electrical communication with the actuator transceiver; wherein the providing the actuator antenna defines: a transmission vector extending between the actuator antenna and the pump antenna; and positioning the pump antenna for communicating wirelessly with the actuator transceiver via the actuator antenna; the actuator antenna supported line-set between the proximal and distal ends of the line-set, wherein the transmission vector is generally unobstructed by the user and the liquid container; transferring signals between the actuator antenna and the electronics package via the pump antenna; and activating, in response to the transferring signals, the pump to convey liquid from the liquid container to the mouth of the user via the hose thereby hydrating the user Another general aspect of a motorsports handlebar actuator may include: a housing defining an attachment-plane, the housing protruding from the attachment-plane; a printed circuit board (PCB) adjoining the actuator housing, the printed circuit board defining a PCB-plane that is perpendicular to the attachment-plane; a planar battery adjacent to a portion of the printed circuit board, the planar battery may include: a thickness; and a diameter that is greater than the thickness; and a battery-plane adjoining a surface of the planar battery, and the battery-plane is parallel to the PCB-plane; and a switch electrically interfaced with a portion of the printed circuit board, the switch defining a switch-axis that is parallel to the PCB-plane and the battery-plane Another general aspect of a hose coupler may include: an enclosure defining an inlet end and an oppositely disposed outlet end; the enclosure further defining an interior portion and an exterior portion, the enclosure may include: a backflow prevention valve positioned in the interior adjacent to the inlet end; a containment valve positioned between the backflow prevention valve and the outlet end; a fastener side-A formed on the enclosure; a hose interface formed on the enclosure exterior portion at the inlet end, the hose interface further comprises an interior flow-path that is in fluid communication with the enclosure interior portion; a breakaway may include: a tube defining an inlet end and an oppositely disposed outlet end; the tube further defining an interior portion and an exterior portion; a hose interface formed on the tube exterior portion at the tube proximal end; a ramp formed on the tube exterior portion at the tube distal end; a fastener side-B formed on the tube exterior portion; a uni-directional condition wherein: the breakaway is adjoining the enclosure, the breakaway ramp is adjoining the containment valve, and wherein there is a flow-path from the enclosure inlet end to the breakaway outlet end; and an anti-directional condition wherein: the breakaway is separated from the enclosure, and wherein there is no flow-path between the enclosure inlet end and enclosure outlet end Another general aspect of a method of containing liquid in a releasable hose may include: providing a supply tube defining an inlet and an outlet, the inlet interfaced to liquid supply; providing an enclosure attached to the supply tube outlet, the enclosure defining an inlet end and an oppositely disposed outlet end; the enclosure further defining an interior portion and an exterior portion, the enclosure may include: a backflow prevention valve positioned in the interior adjacent to the inlet end; a containment valve positioned between the backflow prevention valve and the outlet end; a fastener side-A formed on the enclosure; a hose interface formed on the enclosure exterior portion at the inlet end, the hose interface further comprises an interior flow-path that is in fluid communication with the enclosure interior portion; providing a breakaway releasably attachable to the enclosure, the breakaway may include: a tube defining an inlet end and an oppositely disposed outlet end, the tube further defining an interior portion and an exterior portion; a hose interface formed on the tube exterior portion at the tube proximal end; a ramp formed on the tube exterior portion at the tube distal end; a fastener side-B formed on the tube exterior portion; providing a distribution tube attached to the breakaway hose interface; attaching the breakaway to the enclosure, wherein the attaching bypasses the containment seal; biasing the containment seal in response to the attaching the breakaway; detaching the breakaway from the enclosure, wherein the detaching restores the containment seal; and containing liquid as a result of the detaching the breakaway.

Another general aspect of a hose clip may include: a planar body defining a front surface and an oppositely disposed back surface, the planar body defining a top edge and an oppositely disposed bottom edge that cooperate to separate the planar body front surface from the planar body back surface; a barb formed on the planar body back surface adjacent to the planar body top edge; and a hose attachment formed on the planar body bottom edge.

Another general aspect of a method of attaching a hose to a helmet may include: providing a hose clip may include: a planar body defining a front surface and an oppositely disposed back surface, the planar body defining a top edge and an oppositely disposed bottom edge that cooperate to separate the planar body front surface from the planar body back surface; a friction-bearing layer formed on the planar body back surface adjacent to the planar body top edge; and a hose attachment formed on the planar body bottom edge; sliding the hose clip between a shell and a foam liner of the helmet whereby the friction-bearing layer engages the helmet foam liner and is urged into position from a force imparted by the helmet shell; and attaching the hose to the hose attachment.

Another general aspect of a hydration nozzle may include: a base may include: an inlet tube; a sphere formed on the inlet tube; and a liquid path formed from the inlet tube to through the sphere; a nozzle removably attached to the sphere, the nozzle may include: a hollow over-center sphere, wherein the hollow over-center sphere is sealingly attached to the sphere of the base; an exit hole formed in the nozzle; and a flow path formed from the hollow over-center sphere to the exit hole.

BRIEF DESCRIPTION OF THE DRAWING

The accompanying figures of the drawing, which are included to provide a further understanding of general aspects of the portable hydration system, are incorporated in and constitute a part of this specification. These illustrative aspects of the portable hydration system, and together with the detailed description, explain the principles of the system, components, and associated methods. No attempt is made to show structural details of the invention in more detail than may be necessary for a fundamental understanding of the system and various ways in which it may be practiced. The following figures of the portable hydration system include:

FIG. 37 is a perspective view of an illustrative actuator;

FIG. 38 is a perspective, exploded, view of the actuator of FIG. 37;

FIG. 39 is a perspective view of an illustrative printed circuit board (PCB) of the actuator of FIG. 37;

In the appended figures, similar components and/or features may have the same numerical reference label. Further, various components of the same type may be distinguished by following the reference label with a letter. If only the first numerical reference label is used in the specification, the description is applicable to any one of the similar components and/or features having the same first numerical reference label irrespective of the suffix.

DETAILED DESCRIPTION

The ensuing description provides general aspects of a portable hydration system only, and is not intended to limit the scope, applicability or configuration of the disclosure. Rather the ensuing description of the general aspects of the system will provide those skilled in the art with an enabling description for implementing a preferred system. It is understood that various changes may be made in the function and arrangement of the elements without departing from the spirit and scope set forth in the appended claims. It should be noted that while the following description is configured on the portable hydration system of a motorcycle, the system and/or components described herein may be claimed or utilized in other applications as well. For example, the portable hydration system can be used by bicycle riders, military pilots, surgeons needing on-demand irrigation of the operation cavity, operators of heavy equipment, military personnel who are clearing an area, individuals with limited mobility who rely on a wheelchair, and other example applications where a user's hands are generally occupied or are unable to hydrate using conventional means. Regarding other applications for the components, during the development of the overall system, various components were created that may be used in other liquid handling situations. For example, the hose coupler might be used in medical applications, or the helmet nozzle might be mounted directly to a bike. As such, the following description directed to a motorcycle application is meant to illustrate general aspects of the portable hydration system.

Figure 1:
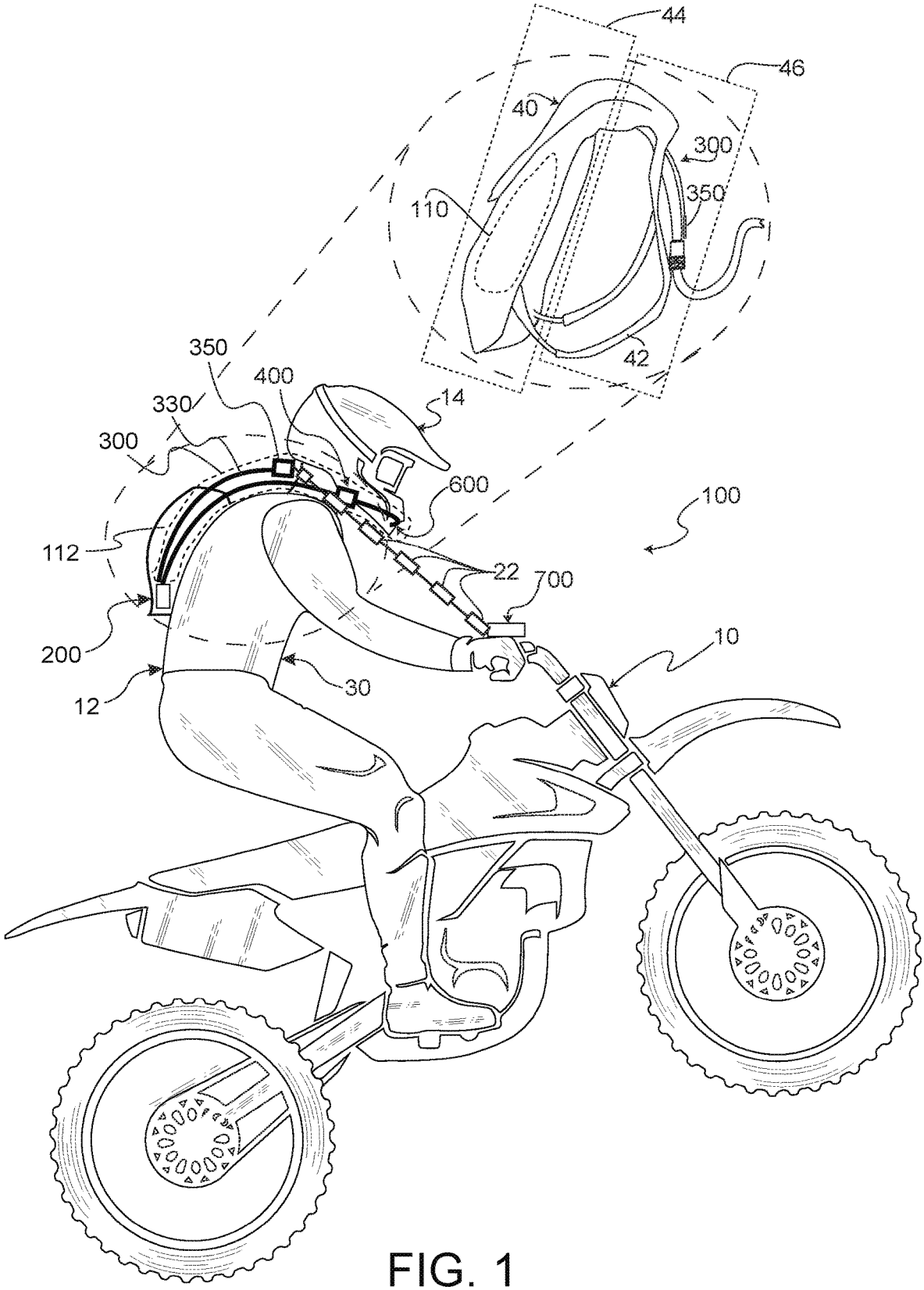
FIG. 1 is a side elevation view of an illustrative portable hydration system used to hydrate a user (e.g. during motorcycling riding), the hydration system includes a liquid container of potable liquid (e.g. water) that is dispensed to the user.

With reference to FIG. 1 showing a side elevation view of an illustrative portable hydration system 100 used while riding a vehicle 10 (e.g. motorcycle), the portable hydration system 100 may include a backpack 40, a liquid container 110, a pump assembly 200, a line-set 300, and an actuator 700 (also referenced to, in one illustrative disclosure, as a motorsports handlebar actuator) that cooperate to deliver potable liquid 112 (FIG. 2, typically water) from the liquid container 110 to a user 12 (via their mouth). The liquid 112 is transferred to the user 12 via the pump assembly 200 and the line-set 300 in a manner that will be described.

Figure 2:
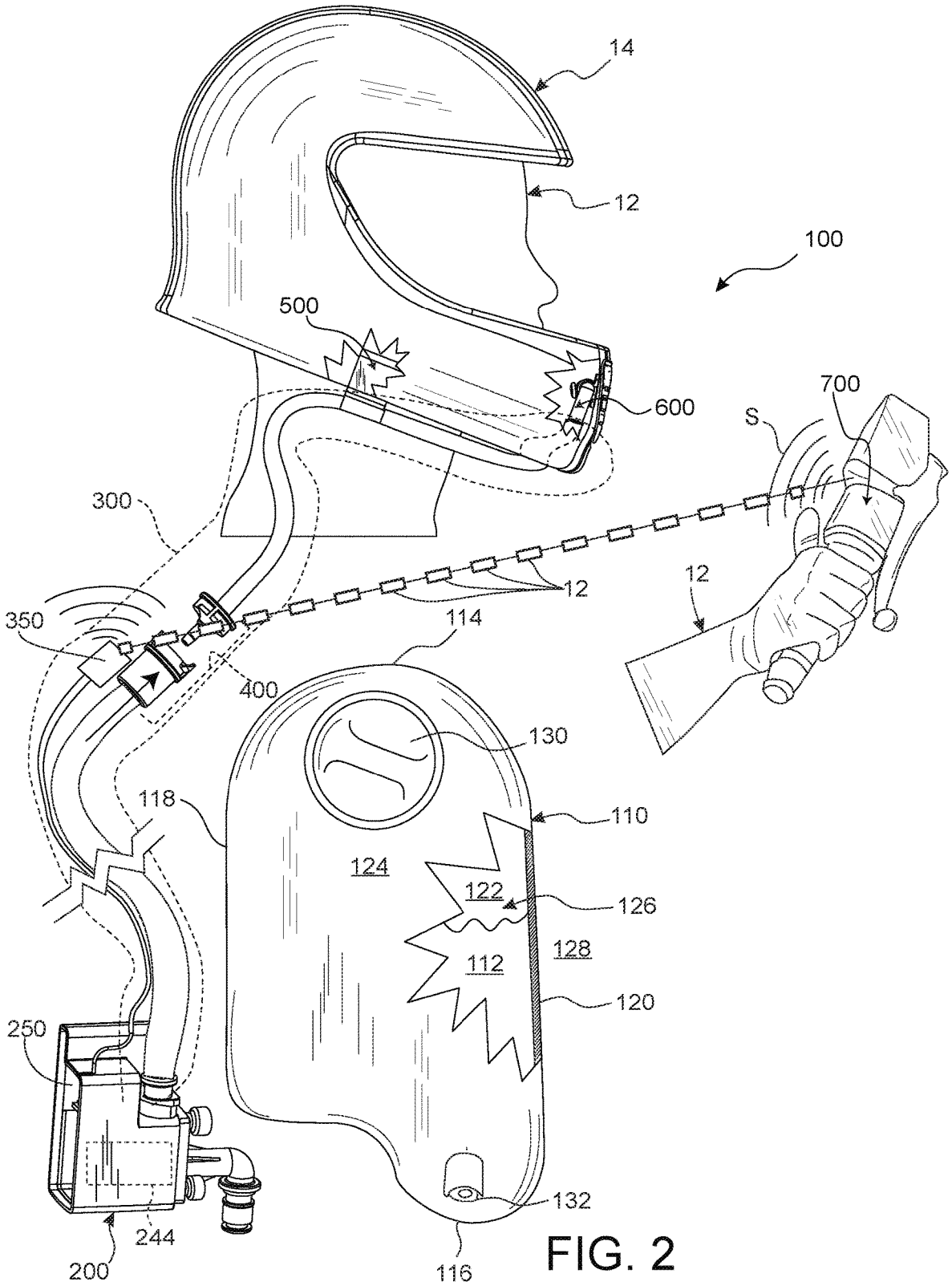
FIG. 2 is a perspective view of an illustrative hydration system including the liquid container, a pump assembly, a line-set, and an actuator.

With reference to FIG. 2 showing a perspective view of the portable hydration system 100, the portable hydration system 100 may also include a hose coupler 400, a helmet clip 500 and a helmet nozzle 600 described herein. It should be noted that while backpack 40 (FIG. 1) could contain the portable hydration system 100, a jacket 30 with a pouch, or other mounting system may be utilized. As used herein, the term pouch refers to a body-worn containment device such as, for example, a pocket in a jacket, a jacket with an integrated fabric opening, a backpack, a messenger bag with at least one strap, or other carrying device. The usage of the portable hydration system 100 is intuitive and begins when the user 12 initiates a request for hydrating liquid via the motorsports handlebar actuator 700 (also referred to as actuator 700) by pushing a lever 760 (FIG. 38) with their thumb or a finger. In response, a signal "S" is generated by an actuator transceiver 790 (FIG. 39), followed by transmission as generally illustrated by a transmission vector 22 that is unobstructed by the liquid container 110 and/or the user 12. The signal S is received by a pump antenna 350 located in the line-set 300. Once the request is initiated, it is forwarded wirelessly to the pump assembly 200 from the motorsports handlebar actuator 700 without generally being blocked/absorbed by the user's body 12 or the liquid container 110 (in other words, it travels along the transmission vector 22 that is relatively unobstructed by the user 12 and the liquid container 110). In response to receiving the signal S, an electronics package 250 causes liquid 112 to be pumped from the liquid container 110 into the pump assembly 200 and ejected to the line-set 300. The liquid travels up the line-set 300 through the (optional) hose coupler 400 and towards the user 12. The line-set 300 may be routed across the bottom edge of a helmet 14 by the helmet clip 500 and the line-set 300 may be further routed into the helmet 14. The helmet nozzle 600 may be used to accurately direct the liquid 112 toward the mouth of the user 12. While many details will be provided, this brief description provides a general understanding of one illustrative portable hydration system 100.

With continued reference to FIG. 2, the liquid container 110 generally defines a top 114, a bottom 116, a left side 118 and a right side 120 that assist in offsetting a back surface 122 from a front surface 124, thereby forming an interior portion 126, which is separate from an exterior portion 128. The liquid container 110 is further provided with a filling port 130 formed in the front surface 124 that, when used, allows the user 12 to move liquid 112 from the exterior portion 128 to the interior portion 126 (i.e. to fill the liquid container 110). The liquid container 110 is provided with an exit port 132 generally located near the bottom 116. This exit port 132 serves as the attachment point and for fluid communication, directly or indirectly, to the pump assembly 200. While the liquid container 110 may typically be configured with either rigid walls (e.g. plastic tank) or compliant walls (hydration bladder), it may simply be a connection to larger water distribution system depending on the application as noted above. A handicapped user might receive liquid from a liquid container configured as a large storage tank mounted to their wheelchair, or a fighter pilot might receive liquid from a liquid container far away from the cockpit. In the illustration, the example liquid container 110 is configured as a hydration bladder. In another illustration, the example liquid container 110 is configured to be pressurized by fluid (specifically air).

Figure 3:
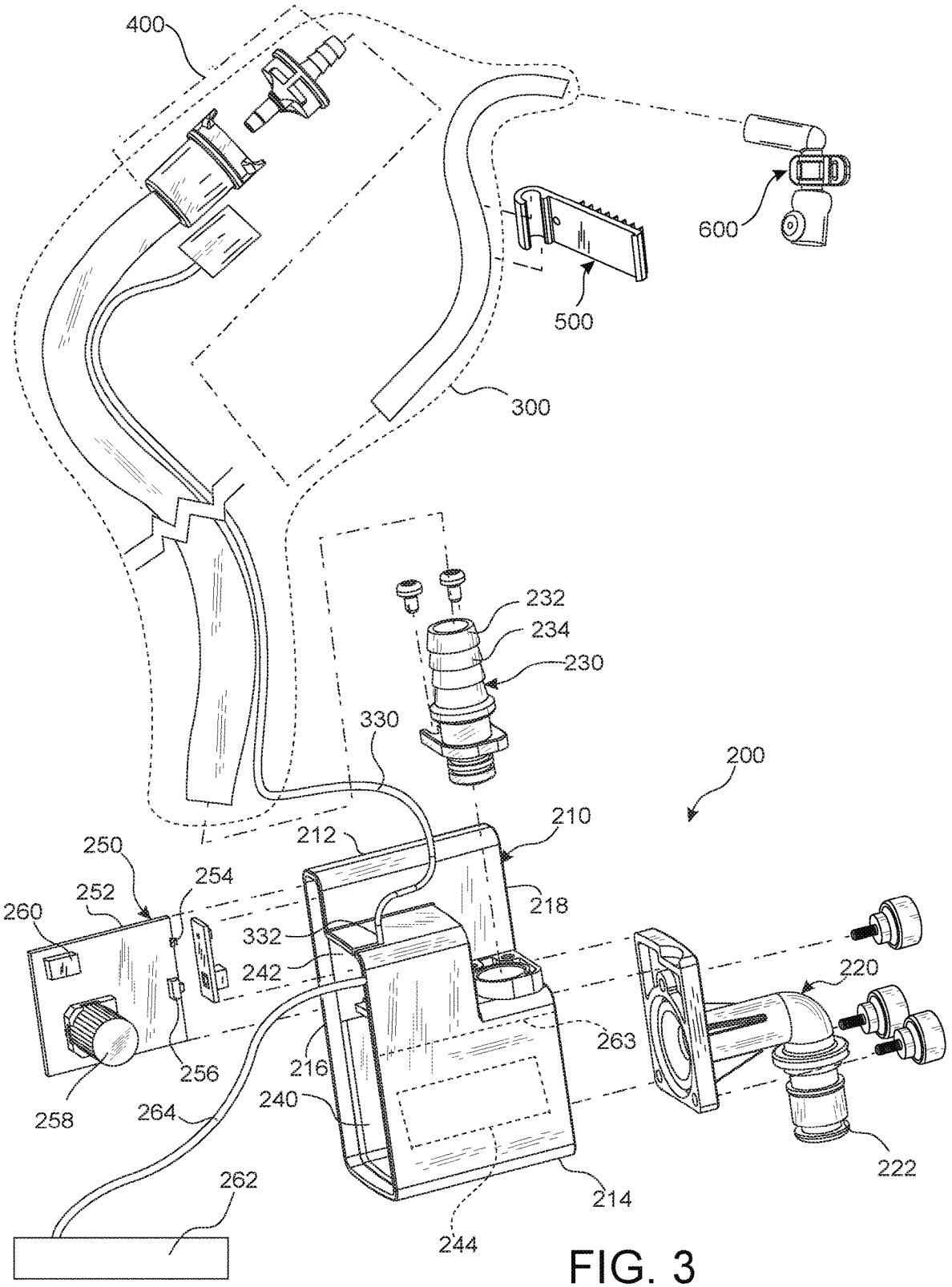
FIG. 3 is a perspective, exploded, view of an illustrative pump assembly, the pump assembly includes a pump and an electronics package for selectively dispensing liquid to a line-set.

With reference to FIG. 3 showing a perspective and exploded view of one illustrative pump assembly 200, the pump assembly 200 includes a main enclosure 210. The main enclosure 210 defines a top 212, a bottom 214, a left side 216, and a right side 218 configured with various profiles and features as illustrated. The pump assembly 200 is further provided with an inlet 220 and an outlet 230, the inlet 220 may be removably attached to the main enclosure 210 to enable cleaning during interval cleaning or to troubleshooting operation. The inlet 220 includes at least one o-ring gland 222 for receiving an o-ring (not shown) that assists with full sealing when the pump assembly inlet 220 is attached to the exit port 132 (FIG. 2) of the liquid container 110 (FIG. 2). The outlet 230 may be attached to the pump assembly main enclosure 210 via fasteners as shown to enable interval cleaning or to troubleshoot operation. The outlet 230 may have any type of hose connection features, such as the illustrated barbs 232, 234 for connecting and sealing to the line-set 300. While the main enclosure 210 may be configured in several ways, as illustrated, there may be two cavities: a pump cavity 240 and an electronics cavity 242. The pump cavity 240 receives a pump 244 and the electronics cavity 242 receives an electronics package 250. While the pump 244 may be any of a variety of types of pumps, a centrifugal pump that operates at 12 volts DC and controlled, for example, with pulse width modulation (PWM). One example of a pump and controls system is found in U.S. Pat. No. 10,179,726 issued on Jan. 15, 2019 to Matthew J. Steele, an inventor of the present portable hydration system 100. This US Patent is specifically incorporated by reference. The electronics package 250 includes a printed circuit board (PCB) 252, the printed circuit board (PCB) 252 may be provided with various electronics such as an indicator 254, a switch 256, a capacitor 258 and a transceiver 260 (also referred to herein as a pump transceiver 260). The indicator 254 and switch 256 may, for example, be used for power regulation and pairing operation. The capacitor 258 and transceiver 260 are utilized for controlling the pump 244 via, for example, user-indicated instructions to deliver liquid (described herein). The electronics package 250 may further include a power supply, such as a battery 262. The battery 262 may be interfaced to the electronics package 250 via a battery lead 264. The battery 262 may be integrated into the vehicle 10, or may be a stand-alone battery that is, typically, relatively small (e.g. a lithium prismatic cell that is rechargeable). In one configuration, the battery 262 may be provided with a connector (not shown) provided for recharging. The electronics package 250 and the pump 244 may be sealingly integrated with the main enclosure 210 by pouring an epoxy, RTV silicone, urethane, or other potting compound into the void between these items and the main enclosure 210. When the pump 244 is activated, liquid is moved from the inlet 220 to the outlet 230 in a manner which is well known to those skilled in the art.

Figure 4:
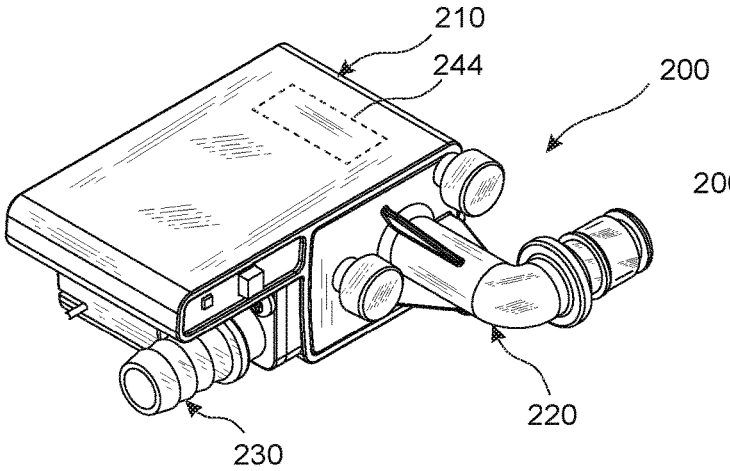
FIG. 4 is a perspective view of the pump assembly of FIG. 3.

With reference to FIG. 4 showing a perspective view of the pump assembly 200, the inlet 220 and outlet 230 are attached to the main enclosure 210. This attachment may be washable or cleanable in order to remove contaminates in the pump assembly 200 and to generally access an impeller of the pump assembly 200.

Figure 5:
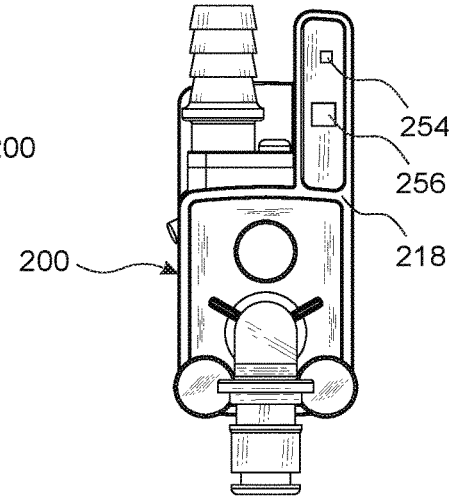
FIG. 5 is a side elevation view of the pump assembly of FIG. 3.

With reference to FIG. 5 showing a side elevation view of the pump assembly 200, the indicator 254 and the switch 256 are visible and operational from the main enclosure right side 218. During use, the switch 256 may be operated to put the pump assembly 200 into a pairing mode with the motorsports handlebar actuator 700 (FIG. 1). Other modes may be provided and indicated by the switch 256 and indicator 254. U.S. Pat. No. 10,179,716 describes at least one example of a pairing process utilized to wirelessly enroll the actuator 700.

Figure 6:
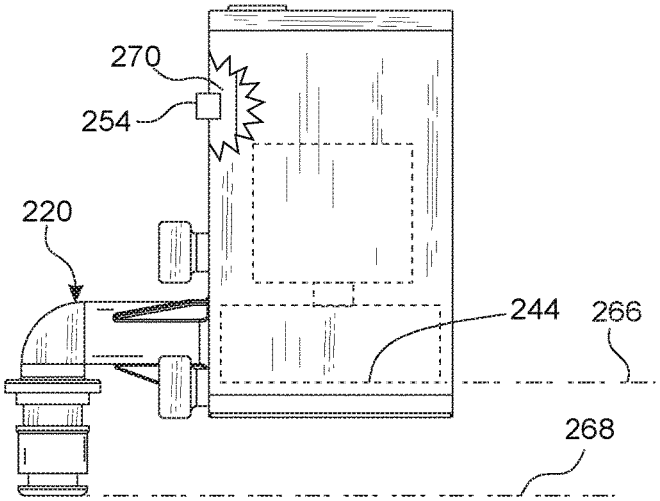
FIG. 6 is a back elevation view of the pump assembly of FIG. 3.
Figure 43:
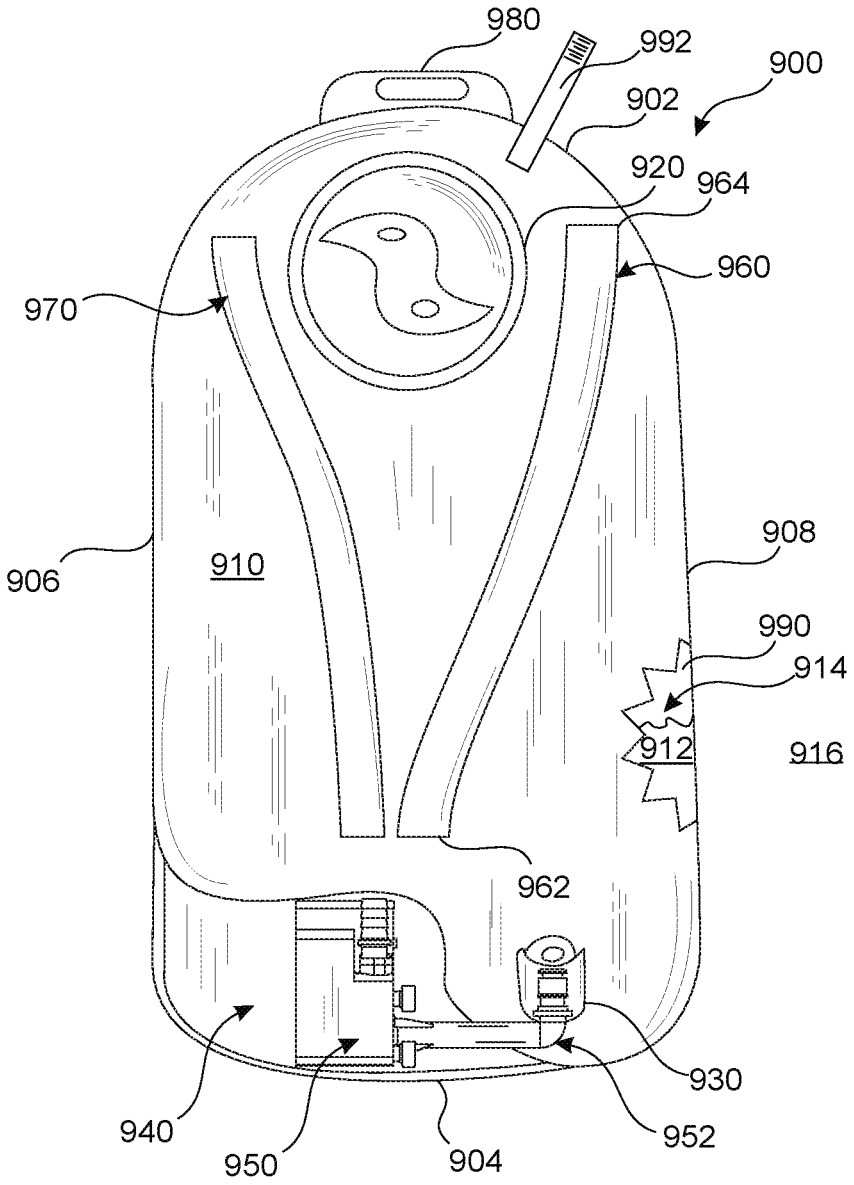
FIG. 43 is back elevation view of an illustrative hydration bladder.
Figure 44:
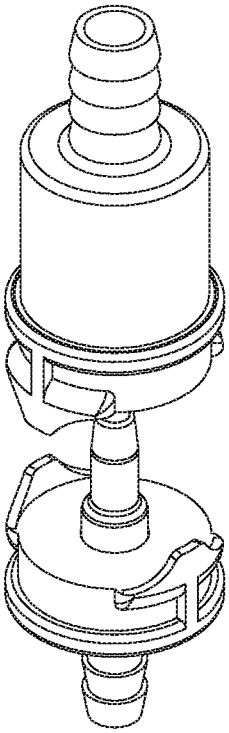
FIG. 44 show a first perspective view of an illustrative ornamental design for a hose coupler.
Figure 45:
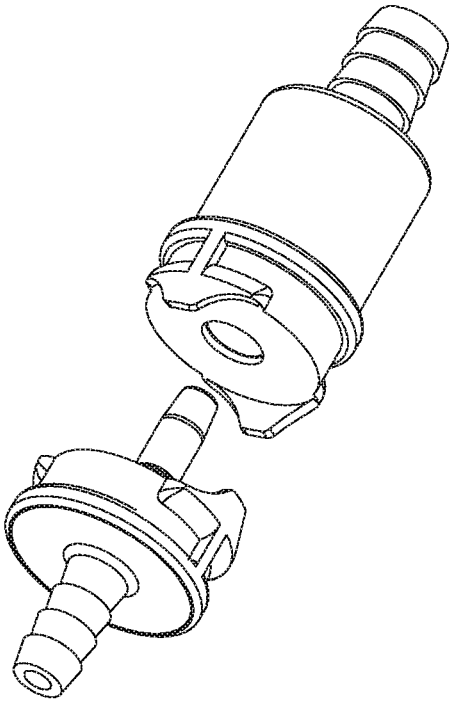
FIG. 45 shows a second perspective view of the hose coupler of FIG. 44.
Figure 46:
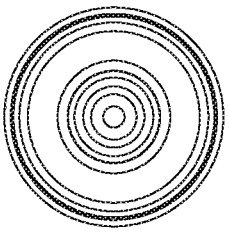
FIG. 46 shows a top plan view of the hose coupler of FIG. 44.
Figure 47:
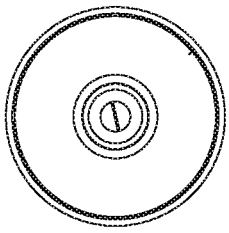
FIG. 47 shows a bottom plan view of the hose coupler of FIG. 44.
Figure 48:
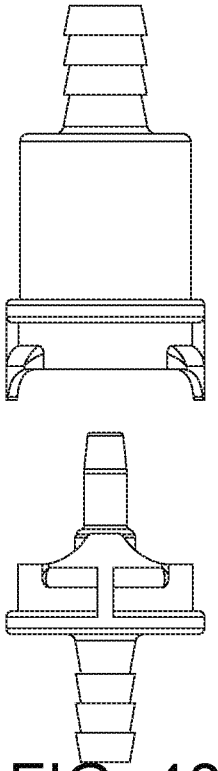
FIG. 48 shows a left elevation view of the hose coupler of FIG. 44.
Figure 49:
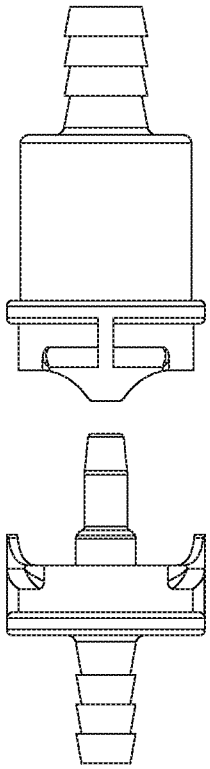
FIG. 49 shows a front elevation view of the hose coupler of FIG. 44.
Figure 50:
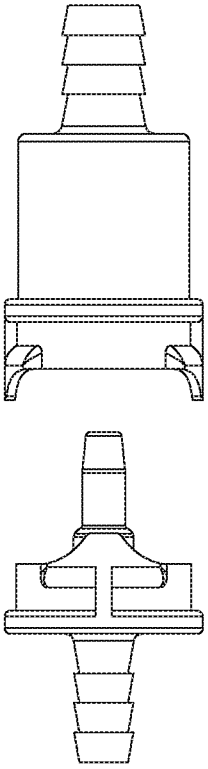
FIG. 50 shows a right elevation view of the hose coupler of FIG. 44.
Figure 51:
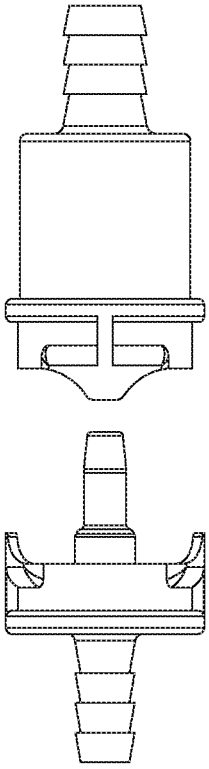
FIG. 51 shows a back elevation view of the hose coupler of FIG. 44.
Figure 52:
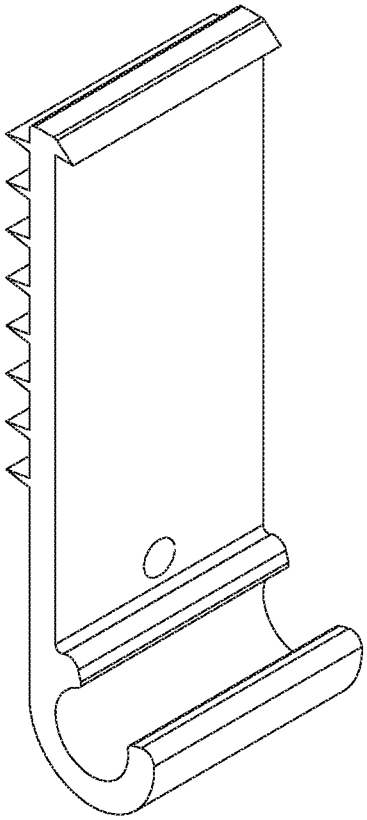
FIG. 52 show a first perspective view of an illustrative ornamental design for a hose clip.
Figure 53:
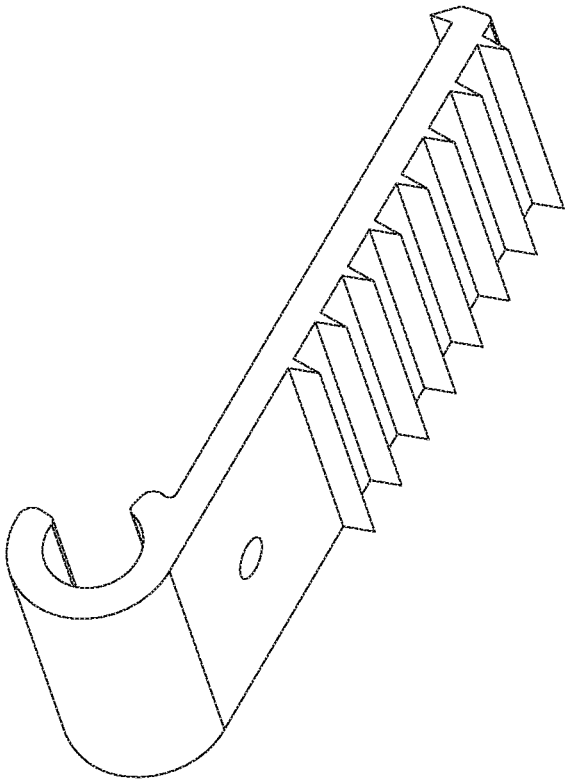
FIG. 53 shows a second perspective view of the hose clip of FIG. 52.
Figure 54:
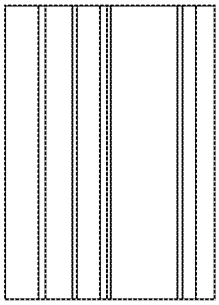
FIG. 54 shows a top plan view of the hose clip of FIG. 52.
Figure 55:
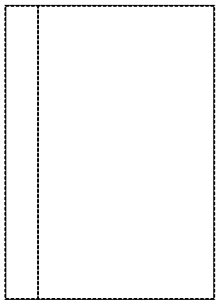
FIG. 55 shows a bottom plan view of the hose clip of FIG. 52.
Figure 56:
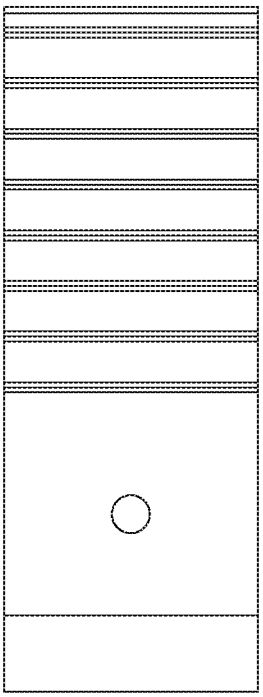
FIG. 56 shows a back elevation view of the hose clip of FIG. 52.
Figure 57:
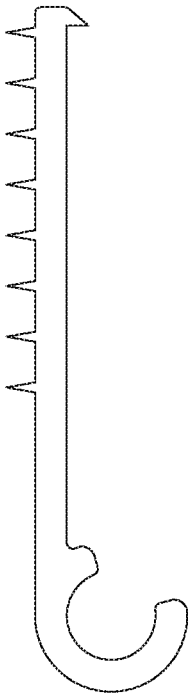
FIG. 57 shows a left elevation view of the hose clip of FIG. 52.
Figure 58:
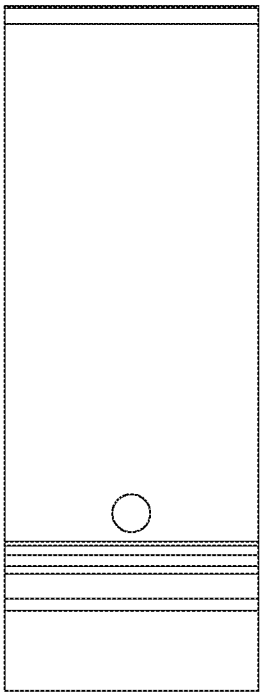
FIG. 58 shows a front elevation view of the hose clip of FIG. 52.
Figure 59:
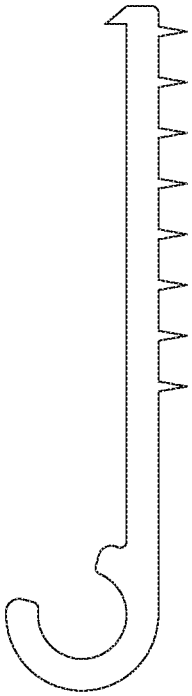
FIG. 59 shows a right elevation view of the hose clip of FIG. 52.
Figure 60:
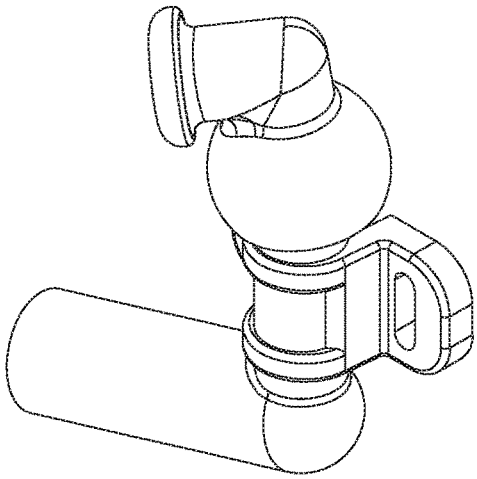
FIG. 60 show a first perspective view of an illustrative ornamental design for a nozzle.
Figure 61:
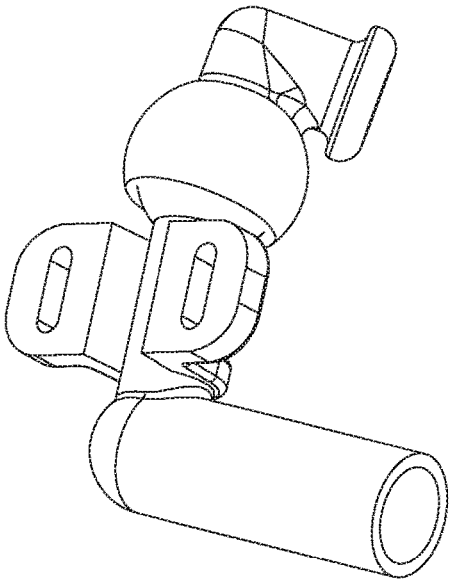
FIG. 61 shows a second perspective view of the nozzle of FIG. 60.
Figure 62:
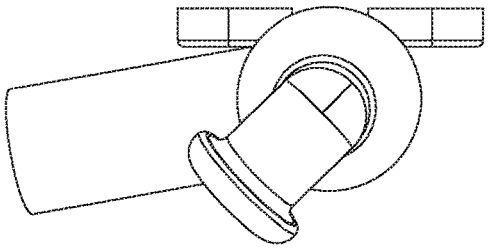
FIG. 62 shows a top plan view of the nozzle of FIG. 60.
Figure 63:
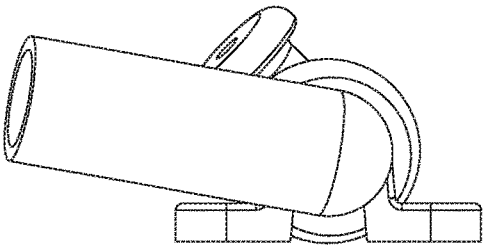
FIG. 63 shows a bottom plan view of the nozzle of FIG. 60.
Figure 64:
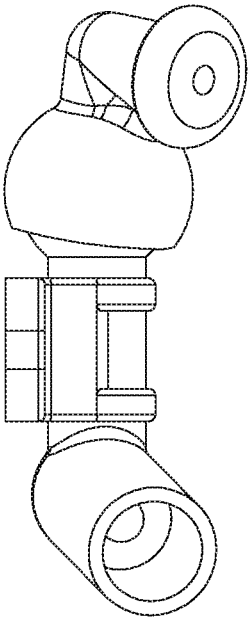
FIG. 64 shows a left elevation view of the nozzle of FIG. 60.
Figure 65:
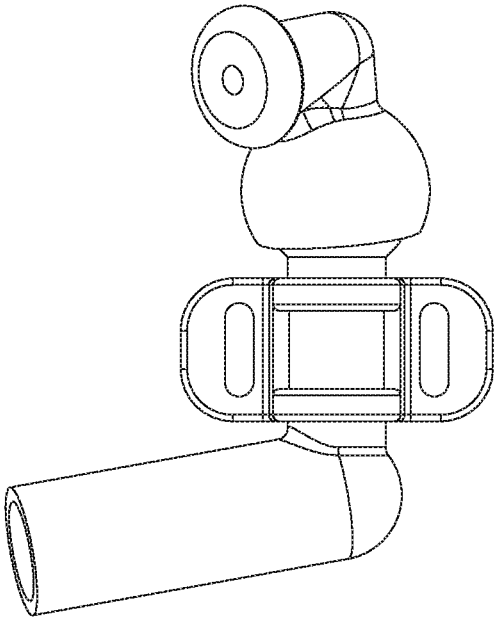
FIG. 65 shows a front elevation view of the nozzle of FIG. 60.
Figure 66:
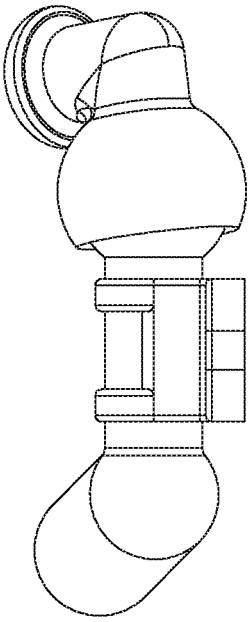
FIG. 66 shows a right elevation view of the nozzle of FIG. 60.
Figure 67:
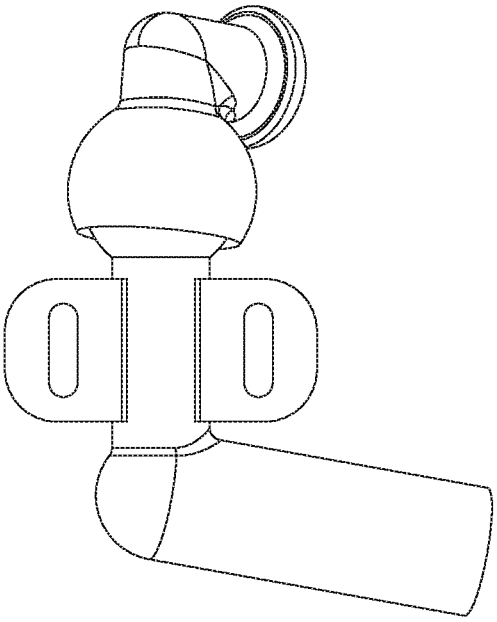
FIG. 67 shows a back elevation view of the hose clip of FIG. 60.
Figure 68:
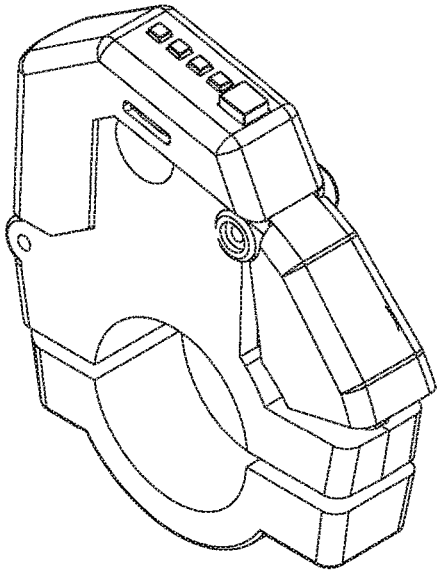
FIG. 68 show a first perspective view of an illustrative ornamental design for an actuator.
Figure 69:
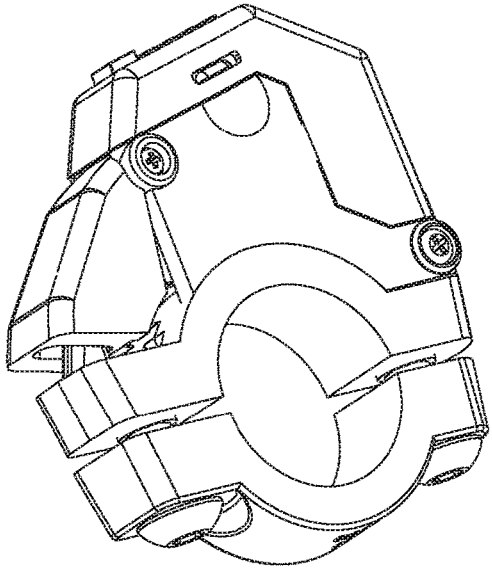
FIG. 69 shows a second perspective view of the actuator of FIG. 68.
Figure 70:
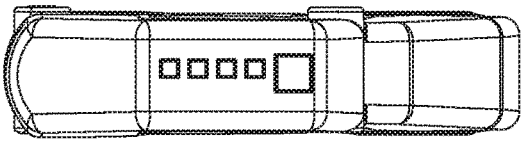
FIG. 70 shows a top plan view of the actuator of FIG. 68.
Figure 71:
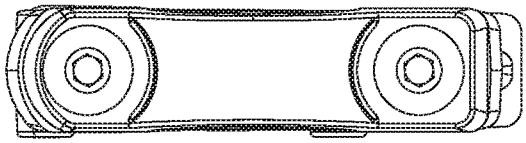
FIG. 71 shows a bottom plan view of the actuator of FIG. 68.
Figure 72:
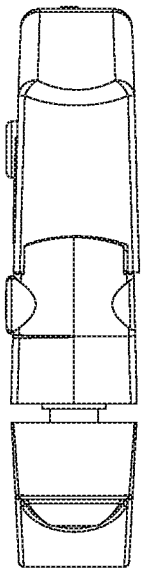
FIG. 72 shows a back elevation view of the actuator of FIG. 68.
Figure 73:
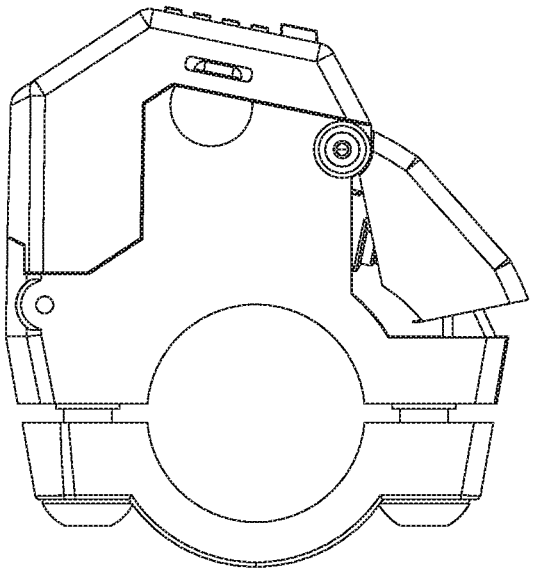
FIG. 73 shows a left elevation view of the actuator of FIG. 68.
Figure 74:
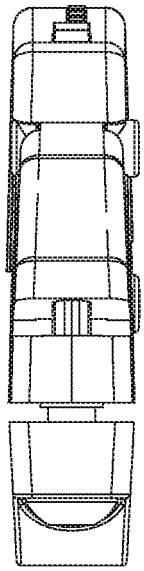
FIG. 74 shows a front elevation view of the actuator of FIG. 68.
Figure 75:
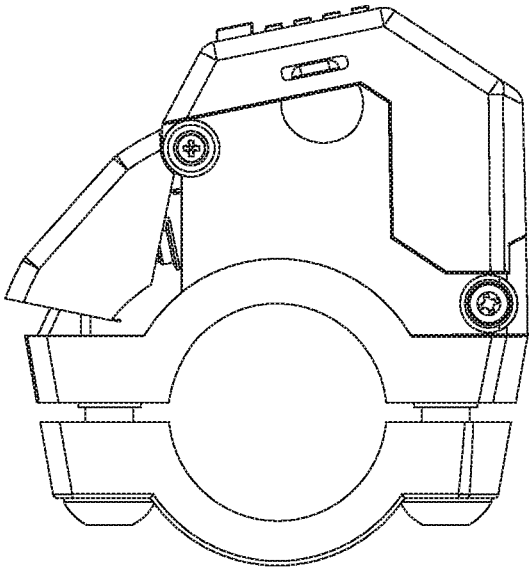
FIG. 75 shows a right elevation view of the actuator of FIG. 68.

With reference to FIG. 6 showing a back elevation view of the pump assembly 200, the inlet 220 defines a pump plane 266 that is separated from an inlet plane 268. This orientation has proven to be useful for priming the pump 244. Most liquid pumps require priming as it is difficult to pump air (a compressible fluid) before reaching an adequate supply of liquid (an incompressible fluid in liquid form). Therefore, the relative orientation of the inlet plane 268 to the pump plane 266 has helped user experience with the portable hydration system 100 described herein. In one configuration, the user may need to suck liquid into the pump assembly 200 to initially position the incompressible liquid. Alternatively, the pump assembly 200 may be rotated (as illustrated in FIG. 43) if different orientations of the exit port 132 (FIG. 2) are utilized.

Figure 8:
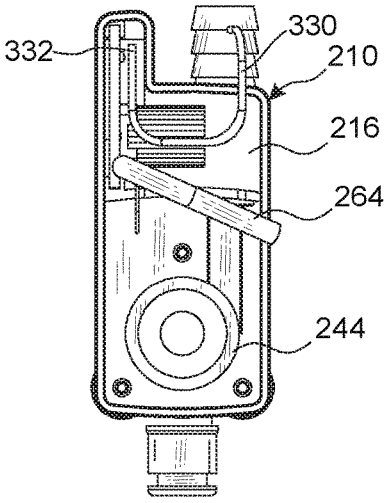
FIG. 8 is a side elevation view of the pump assembly of FIG. 3.
Figure 7:
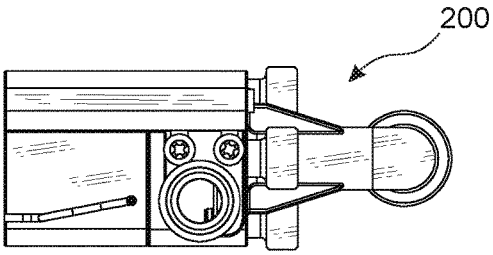
FIG. 7 is a top plan view of the pump assembly of FIG. 3.
Figure 9:
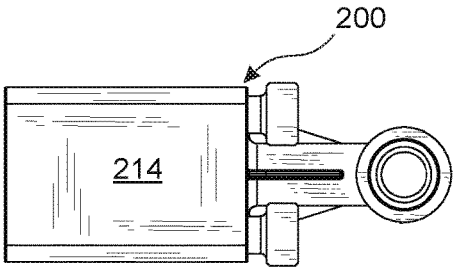
FIG. 9 is a bottom plan view of the pump assembly of FIG. 3.

With reference to FIG. 8 showing a side elevation view of the left side 216 (FIG. 6) of the pump assembly 200, the electronics package 250 and the pump 244 are installed and fully sealed into the main enclosure 210. It is important to note that this view shows how a communications cable 330 of the line-set 300 (FIG. 10) may be attached to the electronics package 250 at a proximal end 332. Additionally, the cable 330 and the battery lead 264 are (optionally) encapsulated during production, in order to protect them from damage (e.g. vibration, water, or other performance limiting exposures, etc.).

Figures 10, 11, 12:
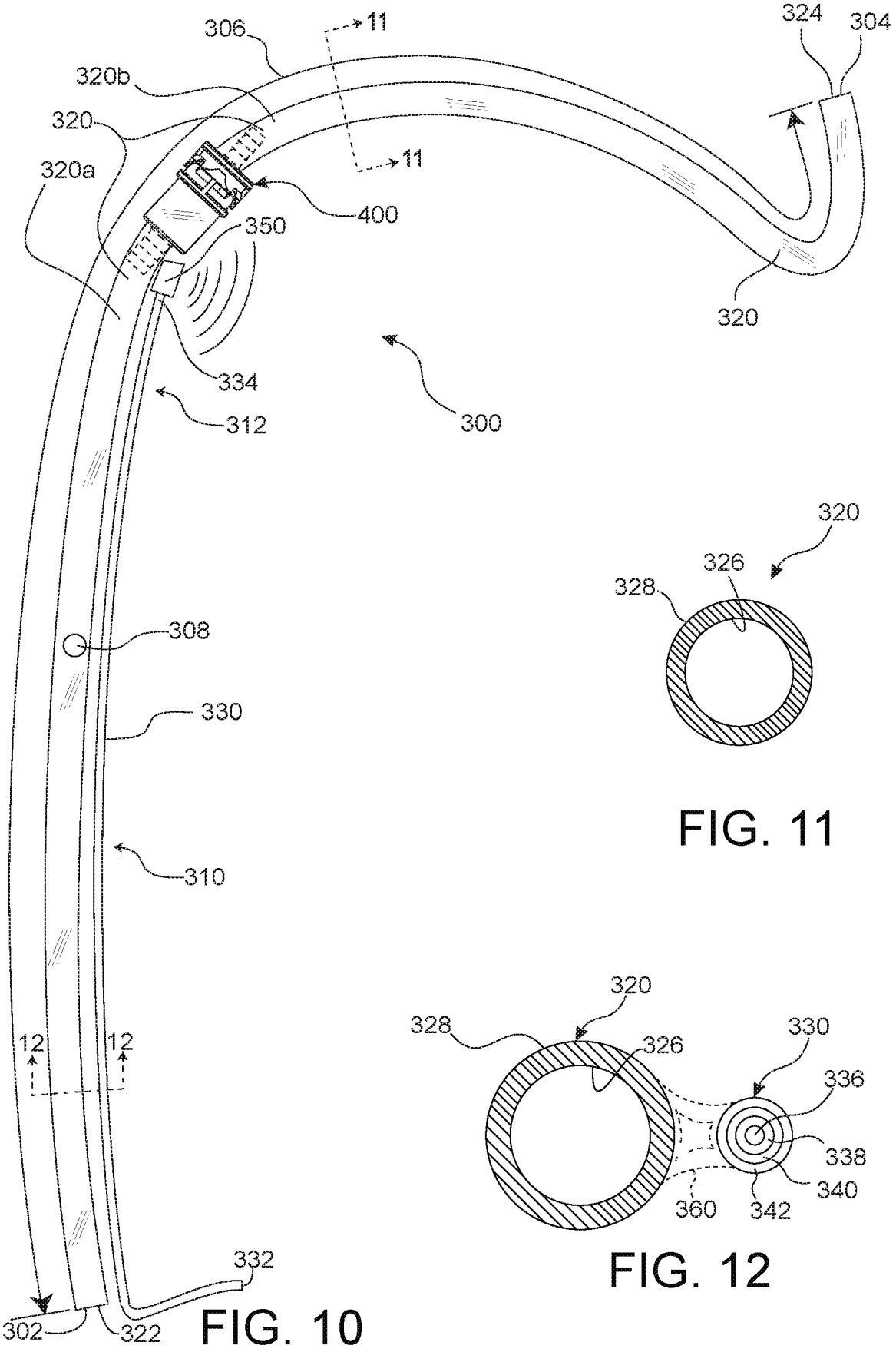
FIG. 10 is a side elevation view of a line-set including an optional hose coupler.
FIG. 11 is a cross-sectional view taken across plane 11-11 of the line-set of FIG. 10.
FIG. 12 is a cross-sectional view taken across plane 12-12 of the line-set of FIG. 10.

With reference to FIG. 10 showing a side elevation view of the line-set 300, as illustrated, the line-set 300 is an elongated assembly that may include the (optional) hose coupler 400. The hose coupler 400 may be useful in certain applications and will be described herein. However, since the hose coupler 400 may not be utilized in some application, the line-set 300 will be described as one continuous assembly without inline separation point (e.g. hose coupler 400). If provided as a continuous assembly, the line-set 300 includes a proximal end 302 and an oppositely disposed distal end 304. The line-set 300 includes a line-set length 306 spanning from the proximal end 302 to the distal end 304, when in an elongated condition. To be clear, when the line-set 300 is elongated to its maximum line-set length 306, it includes an elongated distance located from the proximal end 302 to the distal end 304 of the line-set 300. The line-set length 306 may be relatively short (for example as short as 8 inches) or relatively long (48 inches), however a length of 39 inches is described in one example. The line-set 300 defines an intermediate-point 308 which is one-third of the line-set length 306 from the proximal end 302. The intermediate-point 308 creates a proximal third 310 and a distal majority 312. As used herein, the term distal majority refers to a section of line-set that is relatively far from its main attachment point. In an example, where the line-set length 306 is 39 inches, the proximal third 310 is about 13 inches long and distal majority 312 is 26 inches long. It should be obvious to the one skilled in the art that different values of line-set length 306 result in different lengths of the proximal third 310 and the distal majority 312.

With continued reference to FIG. 10, in one example which excludes the hose coupler 400, the line-set 300 is provided with a hose 320, the cable 330, and a pump antenna 350. The hose 320 defines a proximal end 322 that may be coplanar (or possibly extend beyond) to the line-set proximal end 302 and an oppositely disposed distal end 324 that is, essentially, adjacent to the user's mouth. In one configuration, the hose 320 is a flexible extrusion made of typical liquid conveyance material that is food grade (e.g. rubber, thermoplastic rubber, polyurethane, silicone, or the like). In another application, the line-set 300 of the portable hydration system 100 includes the hose 320 made from 5/16 inch inside diameter (ID) and 7/16 inch outside diameter (OD) food-grade vinyl tube with a Shore 80 A hardness (or within +/−15 Shore). In another application, the line-set 300 has two sections of hose 320 wherein the first section (320*a*) has the 7/16 inch OD in a first section and reduces to a second section (320*b*) with a smaller diameter of, say, 5/16 inch OD (with a 3/16 inch ID). The line-set 300 may be a variety of configurations depending on the application and functionality of the specific portable hydration system 100.

With continued reference to FIG. 10, the (communications) cable 330 defines a proximal end 332 and an oppositely disposed distal end 334. The cable proximal end 332 extends beyond the line-set proximal end 302 as shown for routing the cable 330 to the electronics package 250. The cable distal end 334 may be located anywhere along the line-set 300 at a position where the distal end 334 is unobstructed by the user 12 or the fluid reservoir 110. In one configuration, the distal end 334 of the cable 330 can be positioned in the line-set distal majority 312—therefore somewhere between the line-set intermediate-point 308 and the line-set distal end 304. In another configuration, the distal end 334 of the cable 330 is positioned 21.65 inches from the proximal end 302 of the line-set 300 with a total line-set length 306 of 38 inches; in this configuration, the distal end 334 is positioned "in" the distal majority 312 of the line-set 300.

With reference to FIG. 11 showing a cross sectional view taken across plane 11-11 (FIG. 10), the hose 320 of the line-set 300 includes an interior surface 326 and an exterior surface 328. Liquid 112 is pumped through the line-set 300 which contacts the interior surface 326 as it travels from the proximal end 322 to the distal end 324 of the hose 320.

With reference to FIG. 12 showing a cross-sectional view of the line-set 300 taken across plane 12-12 (FIG. 10), the hose 320 is adjacent to the cable 330. The cable 330 can be any of a number of types of conductors capable of carrying a signal, as known to those skilled in the art. One particularly effective cable 330 is a co-axial cable which allows electrical signal to pass through using an inner conductor 336 surrounded by an insulating layer 338 and all enclosed by a shield 340, and the entire cable 330 may be protected by an outer insulating jacket 342. In one alternative, the hose 320 may be formed with the interior surface 326 and a second passage operable to receive the cable 330 as illustrated by a cable pocket 360. In this alternative, the hose 320 and cable pocket 360 are formed as they are extruded during manufacturing. If provided with the extruded hose 320 and the cable pocket 360, the cable 320 (and optionally, the pump antenna 350, FIG. 10) is disposed within the cable pocket 360 for protection from normal wear-and-tear and unintended impact/abrasion.

With reference again to FIG. 10, the pump antenna 350 provided with the line-set 300 is attached to the distal end 334 of the cable 330. For example, the antenna 350 may be integrated by the manufacture of the antenna 350, or the cable 330 may be attached by a connector, or the cable 330 may be soldered, depending on to find assembly to the antenna 350 (therefore placed in electrical communication with the cable 330). As previously described, the pump antenna 350 may be installed anywhere. However, attaching the pump antenna 350 to the distal end 334 where it is "in" the line-set distal majority 312 provides efficient results. This particular positioning causes the pump antenna 350 on or near a front side, or near a shoulder, of the user 12 where the transmission vector 22 (FIG. 1) is operably unobstructed by the liquid container 110 or the user 12. As used herein, the phrase operably unobstructed means that signals can travel to and from various transceivers that receive and/or send signals. While any of a large variety of types of antennas can be used for the pump antenna 350, one particularly useful type of antenna is a dipole antenna.

Figure 13:
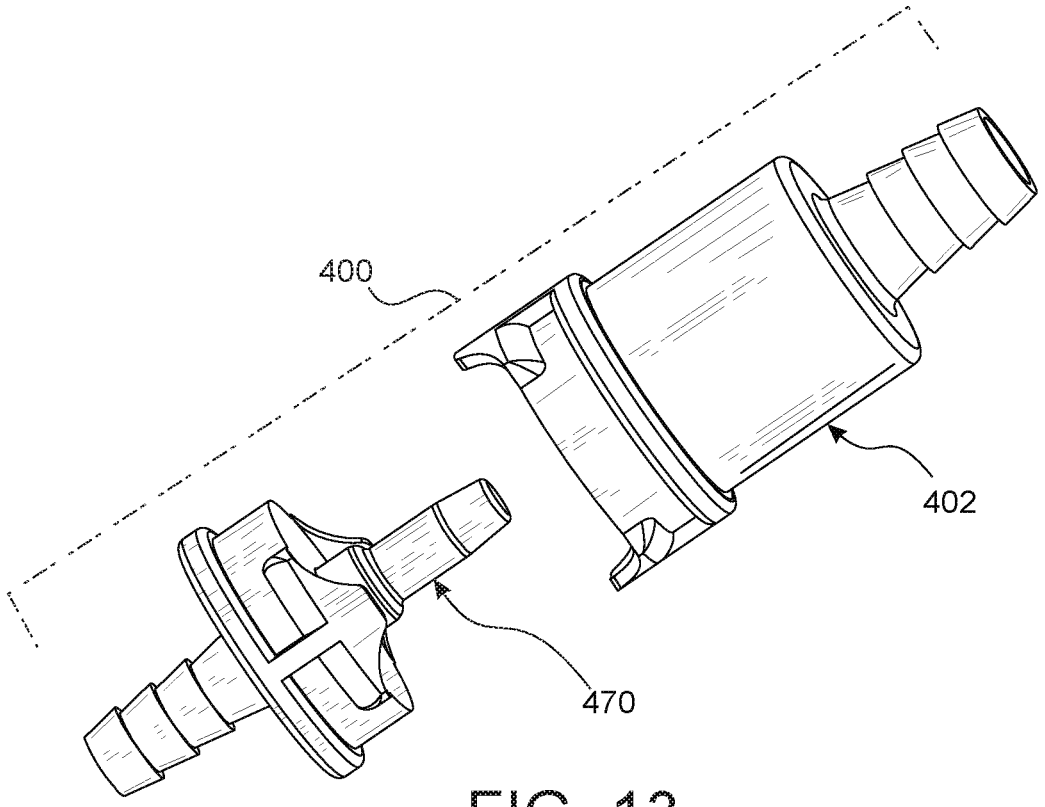
FIG. 13 is a perspective view of an illustrative hose coupler.

With reference to FIG. 13 showing a perspective view of the illustrative hose coupler 400 in an anti-directional condition, the hose coupler 400 includes an enclosure 402 and a breakaway 470. The enclosure 402 and breakaway 470 cooperate to: deliver liquid to the user when engaged, eliminating backflow in any situation, and keeping the pump primed with liquid. Having introduced the benefits of this device, two important conditions will be provided as illustrated in FIG. 14 (anti-directional condition) and FIG. 15 (uni-directional condition).

Figure 14:
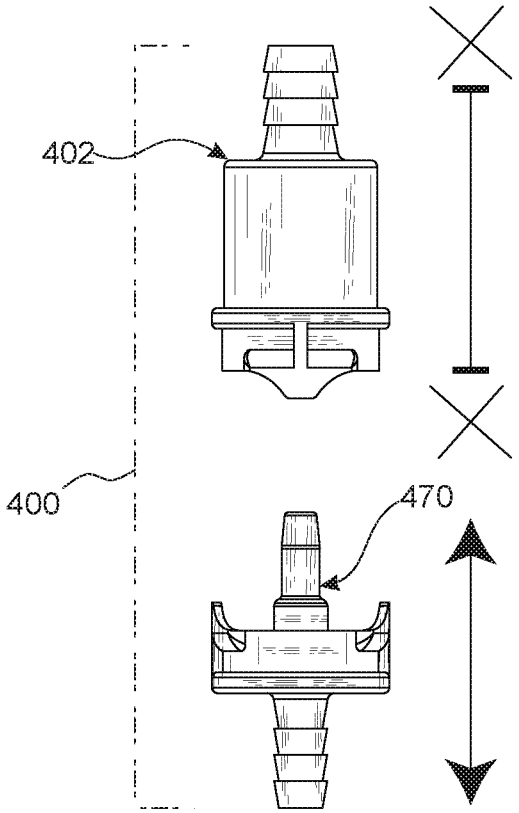
FIG. 14 is a side elevation view of the hose coupler of FIG. 13 in an anti-directional condition.

With reference to FIG. 14 showing a side view of the hose coupler 400, when the breakaway 470 is fully detached from the enclosure 402, liquid may not flow in or out of the enclosure 402 as illustrated by the two "X" icons in FIG. 14. This condition is referred to herein as an "anti-directional condition". The anti-directional condition is useful during times when the helmet 14 (FIG. 1) is not close to the user 12.

Figure 15:
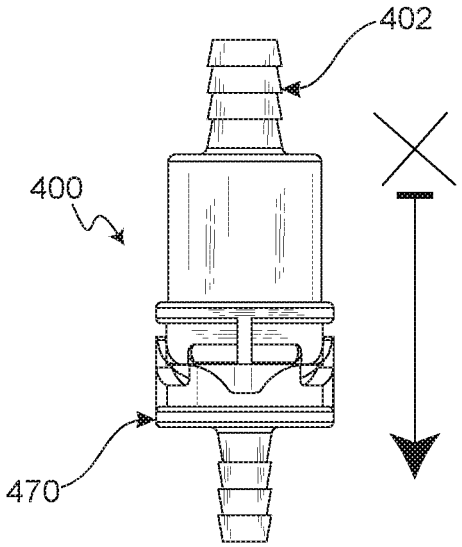
FIG. 15 is a side elevation view of the hose coupler of FIG. 13 in a uni-directional condition.

With reference to FIG. 15 showing a side view of the hose coupler 400 when the breakaway 470 is fully engaged with the enclosure 402, liquid can flow from the enclosure 402 into the breakaway 470. This condition is referred to herein as "uni-directional condition". The enclosure 402 is engaged to the breakaway 470 by any of a variety of fasteners where a side-A engages with a side-B. Examples of these type of fasteners include, but are not limited to: hook-and-loop material, a cantilevered detent, snaps, a magnet-and-iron pair, a north/south pair of magnets, at least one thread, removable adhesive, etc. In one example, a pair of magnets is particularly useful as they provide sufficient attractive force and a tactile 'snap' once they are fully engaged.

Figure 16:
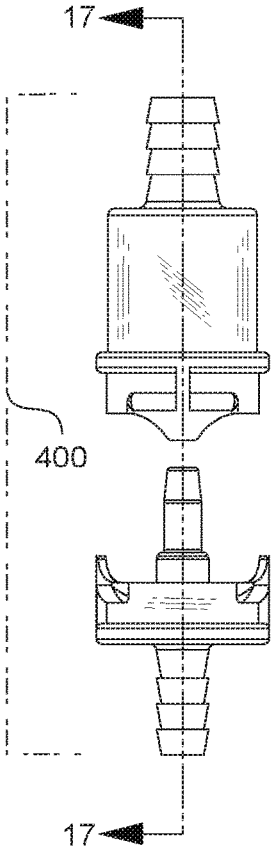
FIG. 16 is a side elevation view of the hose coupler of FIG. 13.
Figure 17:
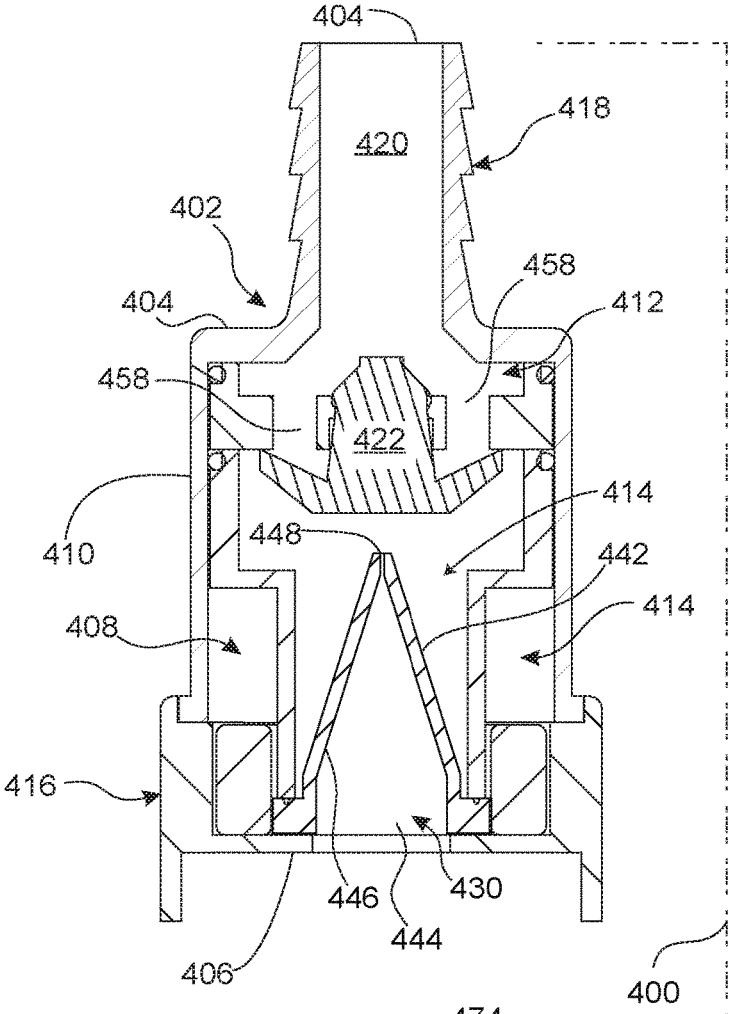
FIG. 17 is a cross-sectional view taken across plane 17-17 of the hose coupler of FIG. 16.
Figure 17:
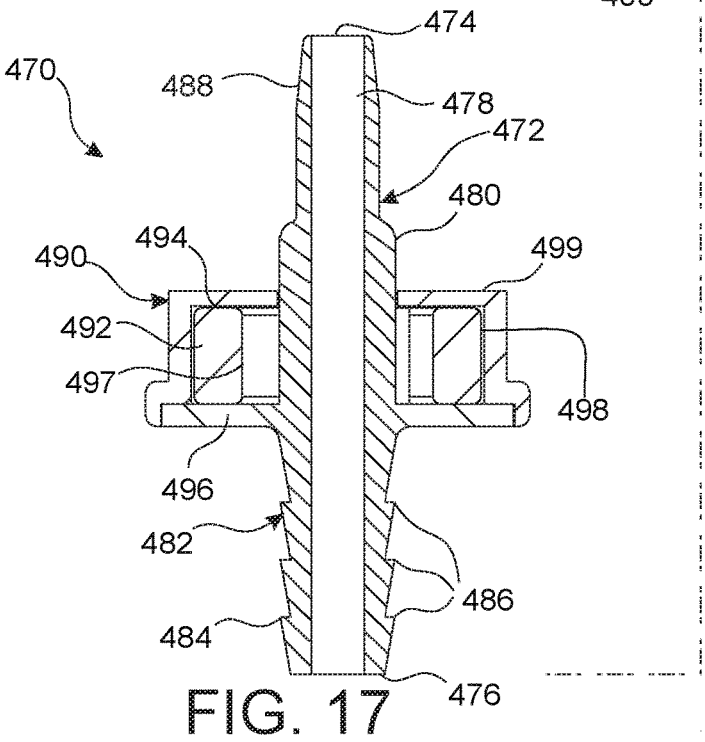

With reference to FIG. 17 showing a cross-sectional view taken across plane 17-17 (FIG. 16) of the hose coupler 400, the enclosure 402 may be provided with various components that create a structure which enables the uni-directional condition (FIG. 15) and the anti-directional condition (FIG. 14). The enclosure 402 defines an inlet end 404 and an outlet end 406 that are separated by an interior portion 408 and an exterior portion 410. The enclosure 402 may be provided with a backflow prevention valve 412 positioned in the interior portion 408 adjacent to the inlet end 404. The enclosure 402 may be provided with a containment valve 414 positioned between the backflow prevention valve 412 and the outlet end 406. The enclosure 402 may be provided with a fastener 416 that interfaces with a fastener 490 of the breakaway 470. The enclosure 402 may be attached directly to the pump assembly 200, or (as illustrated) to the hose 320 (FIG. 10) wherein the enclosure 402 is provided with a hose interface 418 formed on the enclosure exterior portion 410 at the inlet end 404. The hose interface 418 includes an interior flow path 420 that is in fluid communication with the enclosure interior portion 408. Further details of the enclosure 402 will be provided herein (particularly details found in FIGS. 18-24).

With continued reference to FIG. 17, the breakaway 470 may generally define a tube 472. The tube 472 defines an inlet end 474 and an oppositely disposed outlet end 476 that are separated by geometry with an interior portion 478 and an exterior portion 480 as illustrated. The tube exterior portion 480 may include a hose interface 482 formed thereon and near the outlet end 476. The hose interface 482 is provided for receiving the hose 320 (FIG. 10). One way of fully and sealingly engaging the hose 320 to the breakaway 470 can be to utilize a barb 484 with geometry that is easy to push into the hose interior surface 326 (FIG. 11). However, shortly after installation, it is relatively difficult to remove the hose 320 from the barb 484. While one barb 484 may be sufficient to attach the hose 320, other mechanisms such as hose clamps, adhesive, twist wire, shrink-fit, or other attachment schemes can be utilized. In one general aspect, a plurality of barbs 486 may be utilized to improve the attachment and sealing capabilities of the breakaway 470 to the hose 320. The breakaway 470 may be further include the ramp 488 formed on the tube exterior portion 480 near the inlet end 474. The ramp 488 is provided for engaging with components of the enclosure 402 (specifically the containment valve 414, as described herein).

With continued reference to FIG. 17, the breakaway 470 further includes a fastener 490 formed on the tube exterior portion 480. While a larger number of fastening methods may be employed (as previously described when describing FIG. 13; e.g. hook-and-loop material, a cantilevered detent, a magnet-and-iron pair, a north/south magnet pair, a thread, or the like) one particularly useful fastener is a magnet 492. If the fastener 490 is configured as a magnet 492, it may include one or more individual magnets spaced circumferentially about the tube 472 or a ring-shaped magnet. If the ring-shaped magnet is utilized as illustrated, the magnet 492 defines a top surface 494 and an oppositely disposed bottom surface 496. The top surface 494 and the bottom surface 496 of the magnet 466 are separated by an interior surface 497 and an exterior surface 498. The magnet interior surface 497 is positioned adjacent to or adjoining the exterior portion 480 of the tube 472. The magnet 492 may be positioned and retained in the breakaway 470 by a cap 499 as best illustrated in FIG. 17. The cap 499 contacts the magnet top surface 494 and the magnet exterior surface 498 such that it is held in position by a snap fit, adhesive, or ultrasonic welding (or their mechanical equivalents).

Two key components of creating the enclosure 402 that cooperate to achieve the anti-directional condition (FIG. 14) and uni-directional condition (FIG. 15) are the backflow prevention valve 412 and containment valve 414. These valves 412, 414 may take any type configuration and/or orientation, but one illustrative geometry can be the backflow prevention valve 412 including an umbrella valve 422 (FIG. 18) and the containment valve 414 being a duckbill valve 430 (FIG. 20).

Figure 18:
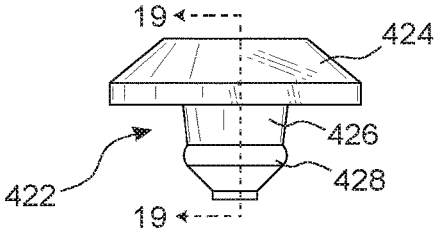
FIG. 18 is a side elevation view of an illustrative umbrella valve.

With reference to FIG. 18 showing a side elevation view of an illustrative umbrella valve 422 formed with a cap 424 and a stem 426. The umbrella valve 422 is made of a compliant (flexible) material such as rubber, urethane, flexible plastic, polyurethane, silicone, or any other material capable of repeatedly moving from one position to another. The umbrella valve 422 may be provided with a ring 428 formed on the stem 426 as illustrated; the ring 428 is utilized to interface the umbrella valve 422 with components of the enclosure 402.

Figure 19:
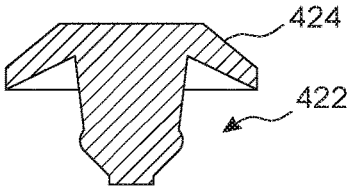
FIG. 19 is a cross-sectional view taken across plane 19-19 of the umbrella valve of FIG. 18.
Figure 24:
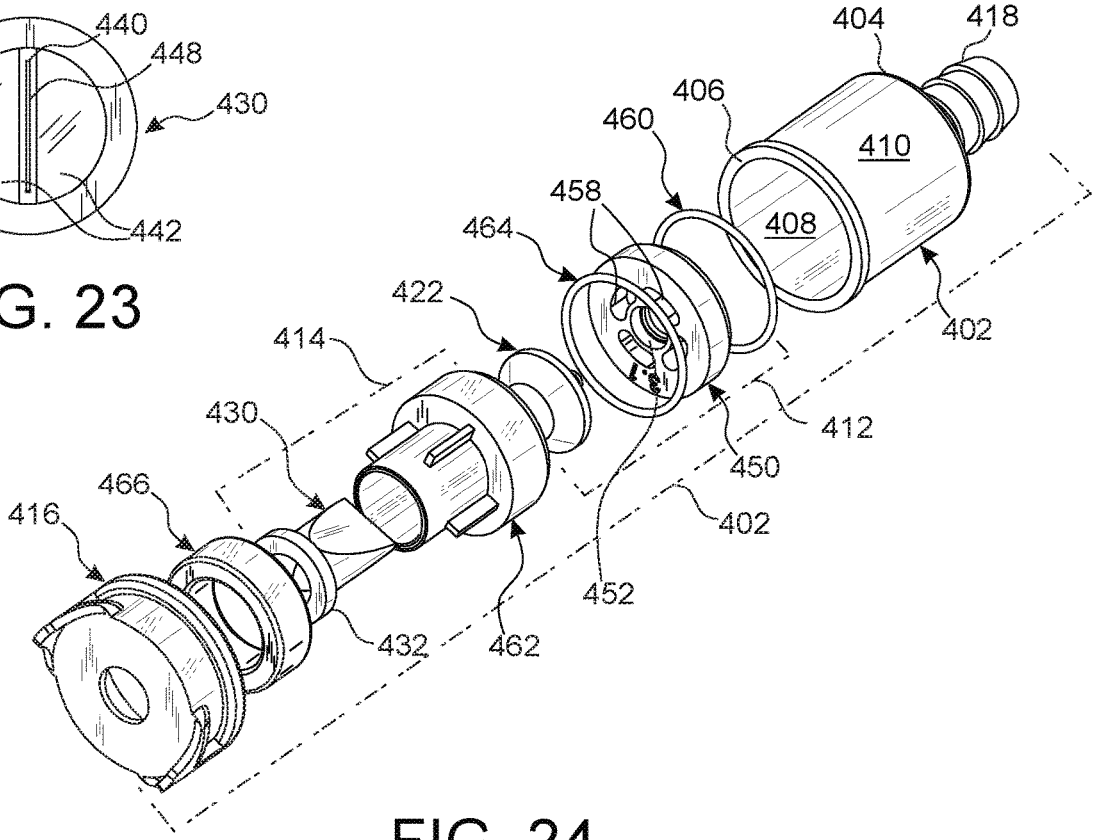
FIG. 24 is a perspective, exploded, view of an illustrative enclosure included with the hose coupler of FIG. 16.

With reference to FIG. 19 showing a cross-sectional view of the umbrella valve 422 taken across plane 19-19 (FIG. 18), the cap 424 is formed so that once it is positioned in the enclosure 402, the cap 424 may be preloaded to hold it in a closed position against an umbrella valve seat 450 (FIG. 24).

Figure 20:
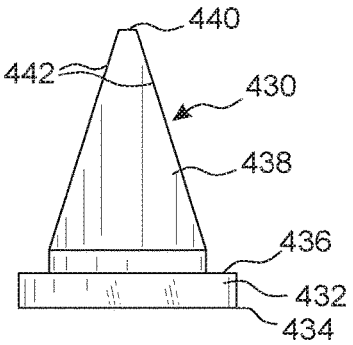
FIG. 20 is a front elevation view of an illustrative duckbill valve.
Figure 21:
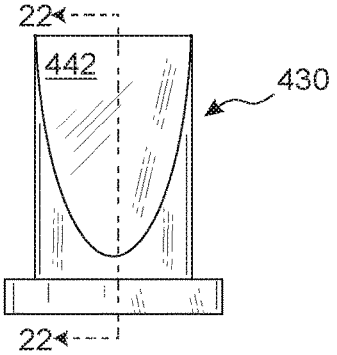
FIG. 21 is a side elevation view of the duckbill valve of FIG. 20.

With reference to FIG. 20 showing a side elevation view of an illustrative duckbill valve 430, the duckbill valve 430 may be provided with a brim 432 that defines a top surface 434 and an oppositely disposed bottom surface 436. The duckbill valve 430 also includes a cap 438 formed on the brim bottom surface 436, the cap 438 includes a bottom surface 440. The cap 438 of the duckbill valve 430 may be formed with a pair of ramps 442. The ramps 442 are useful for creating seal when acted upon by liquid and that can be overcome by the breakaway tube ramp 488 (FIG. 17).

Figure 22:
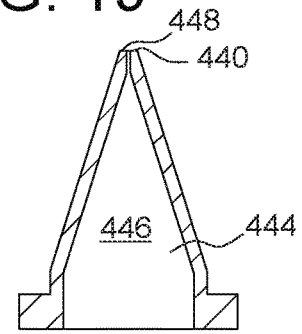
FIG. 22 is a cross-sectional view taken across plane 22-22 of the umbrella valve of FIG. 21.

With reference to FIG. 22 showing a cross-sectional view of the duckbill valve 430 taken across plane 22-22 (FIG. 21), the duckbill valve 430 includes a blind hole 444 that defines an interior wall 446.

Figure 23:
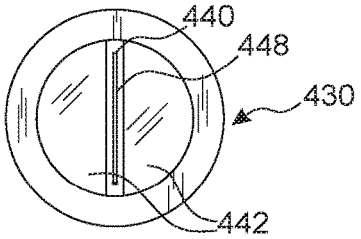
FIG. 23 is a top plan view of the duckbill valve of FIG. 20.

With reference to FIG. 23 showing a top plan view of the duckbill valve 430, the duckbill valve 430 may be provided with a cut 448 formed in the bottom surface 440 and extending from the bottom surface 440 to the interior wall 446 of the blind hole 444. The cut 448 is ideally formed without removing material, and typically by cutting or shearing the duckbill valve 430 with sharp cutter is a method well known to those skilled in the art.

With reference to FIG. 24 showing a perspective view of the enclosure 402 in an exploded condition, the enclosure 402 may further include: the umbrella valve seat 450, an umbrella valve seat o-ring 460, a spacer o-ring 464, an umbrella valve spacer 462, and the fastener 416 (e.g. a magnet 466). The umbrella valve seat 450 includes a valve hole 452 located at a central axis for receiving the umbrella valve 422. The umbrella valve seat 450 defines a first surface 454 and an oppositely disposed second surface 456 through which a plurality of flow channels 458 are formed. The flow channels 458 are covered by the cap 424 of the umbrella valve 422 (best illustrated in FIG. 17). With continued reference to FIG. 24, the umbrella valve seat o-ring 460 seals the umbrella valve seat 450 to the interior portion 408. The umbrella valve spacer 462 may be provided for sealing the brim 432 of the duckbill valve 430 against the fastener 416. The umbrella valve spacer 462 is sealed to the umbrella valve seat 450 and the interior portion 408 by the provided spacer o-ring 464. Regarding fastener 416, while a larger number of fastening methods may be employed (e.g. hook-and-loop material, a cantilevered detent, a magnet-and-iron pair, a north/south magnet pair, a thread, or the like) one particularly useful fastener is a magnet 466. If the fastener 416 is magnet 466, it could be one or more individual circular magnets spaced circumferentially about the fastener 416 or a ring-shaped magnet as illustrated wherein the magnet 466 defines a top surface and an oppositely disposed bottom surface, and a central hole thereby creating a ring geometry substantially identical to features of the magnet 492.

With reference again to FIG. 17, the cross-sectional view illustrates the anti-directional condition wherein liquid is blocked from flowing via the outlet end 406 to the inlet end 404 or vice versa. In particular, the umbrella valve 422 of the backflow prevention valve 412 blocks liquid from entering into the hose 320; and, the duckbill valve 430 of the containment valve 414 blocks liquid from being ejected from the interior flow-path 420 past the outlet end 406. Both the backflow prevention valve 412 and the containment valve 414 act as 1-way valves that are arranged to block flow in either direction and thereby make the anti-directional condition (FIG. 14). In another condition, referenced herein as the uni-directional condition (FIG. 15), the breakaway 470 advances towards the enclosure 402 and fully engages with the fastener 416 of the enclosure 402 and the fastener 490 of the breakaway 470. When engaged, the ramp 488 at the inlet end 474 of the breakaway 470 contacts the blind hole 444 at the interior wall 446. The contact between the ramp 488 and the duckbill valve 430 causes the cut 448 to be held in an open condition that effectively bypasses the 1-way functionality of the duckbill valve 430. In this condition, liquid under pressure flows into the hose coupler 400 at the inlet end 404 of the enclosure 402 and advances through the backflow prevention valve 412 via the flow channels 458, through the cut 448 at the bottom surface 440 of the duckbill valve 430 and into the interior portion 478 of the breakaway 470. Operation in this uni-directional condition continues until the user desires to remove their helmet 14, at a time when the breakaway 470 is disengaged from the enclosure 402.

Figure 25:
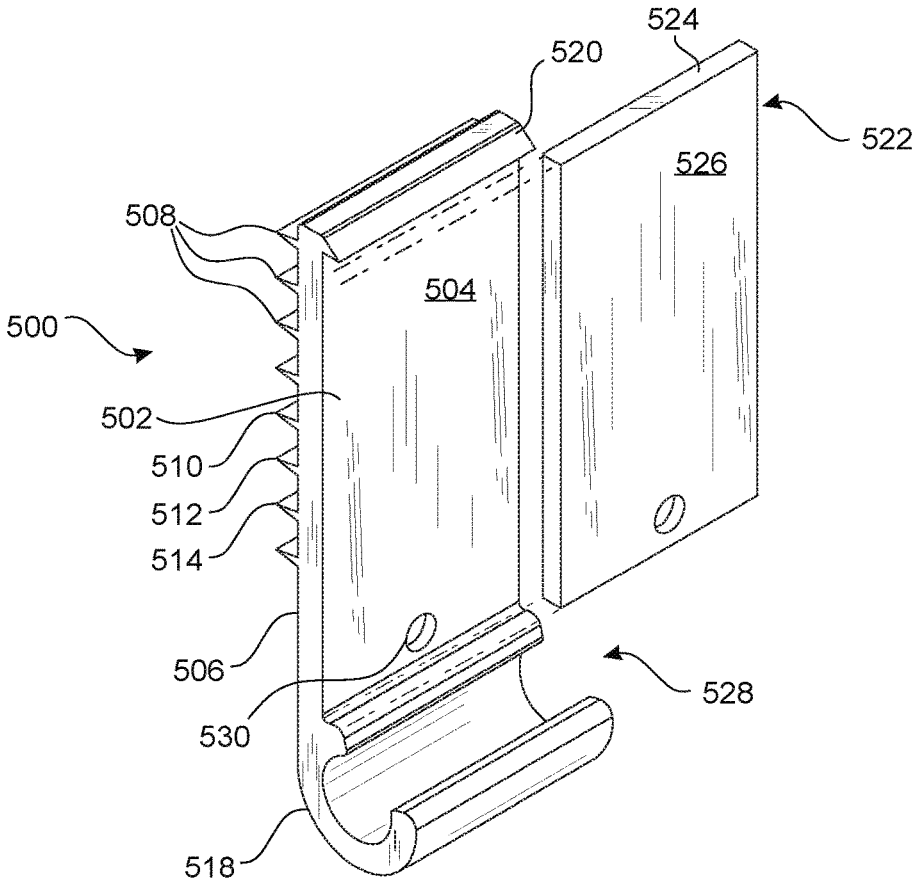
FIG. 25 is a perspective, exploded, view of an illustrative helmet clip.
Figure 26:
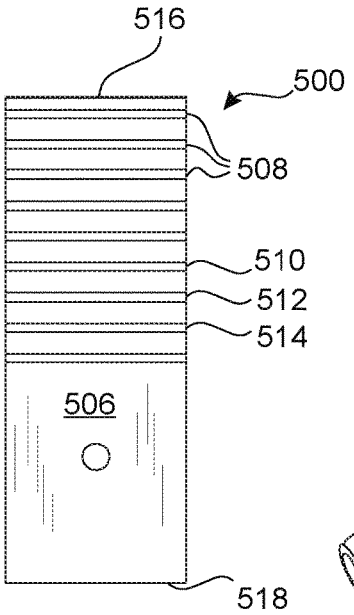
FIG. 26 is a back elevation view of the helmet clip of FIG. 25.
Figure 28:
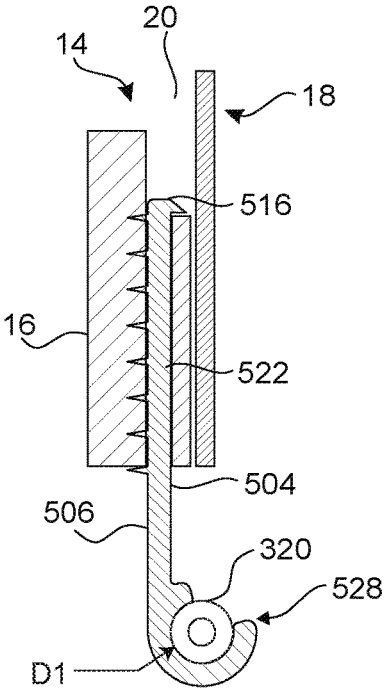
FIG. 28 is a cross-sectional view of the helmet clip of FIG. 25 interfaced with a helmet.

With reference to FIG. 25 showing a perspective and exploded view of a helmet clip 500. The helmet clip 500 is provided with a planar body 502 with a front surface 504 and an oppositely disposed back surface 506. The planar body 504 is made from any of a large variety of materials, such as plastic (e.g. ABS). The planar body 502 includes features formed therewith or applied thereto for enabling the helmet clip 500 to support a hose (e.g. hose 320 of line-set 300, both in FIG. 10) after it is installed on a helmet (e.g. helmet 14, FIG. 1). One way to attach the helmet clip 500 to the helmet 14 may be to provide barbs 508 such as individual barbs 510, 512, 514, etc., on the helmet clip back surface 506. Moreover, any of a large variety of barbs 508 could be implemented, wherein one illustrative geometry may include a ridge formed across the back surface 506. In a process described herein, the barbs 508 mechanically grab the foam of a helmet. The helmet clip 500 further defines a top 516 and an oppositely disposed bottom 518. The helmet clip 500 may include a ramp 520 formed on the front surface 504 near the top 516. The ramp 520 protects a compression layer 522 that may be provided with the helmet clip 500. The compression layer 522 defines an adhesion side 524 and an oppositely disposed friction side 526. The adhesion side 524 is attached to the planar body front surface 504 (as shown in FIG. 28). The compression layer 522 may be any of a variety of materials capable of being compressed and then expanding back to its natural thickness, examples include: rubber, urethane, expanded foam, spun strands of flexible material, etc. The ramp 520 reduces the chance of the compression layer 522 from peeling off the planar body 502.

With continued reference to FIG. 25, the bottom 518 of the planar body 502 is provided with a hose attachment 528.

While the hose attachment 528 could be any of a variety of attachment mechanisms, the illustrated circumferential clip has proven to be a reliable mechanism. Other alternatives to the hose attachment 528 include but are not limited to: hook-and-loop patches, zip-ties, twist-ties, adhesive, full circles, etc. formed onto the bottom 518 of the planar body 502. The hose attachment 528 configured as a circumferential clip has a diameter that matches the hose (e.g. hose 320) it supports.

Figure 27:
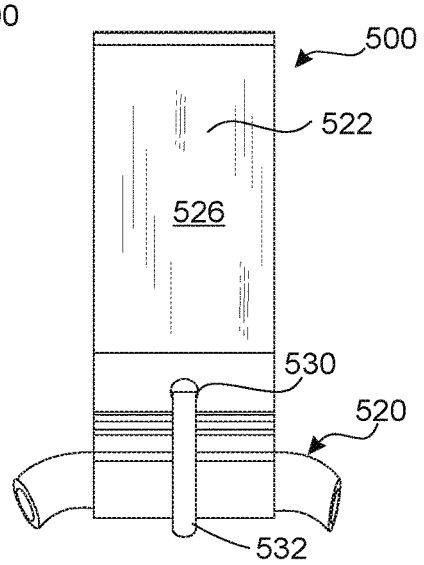
FIG. 27 is a front elevation view of the helmet clip of FIG. 25.

With reference to FIG. 27 showing a front view of the helmet clip 500, the helmet clip 500 may support the hose 320 as illustrated. In some conditions (e.g. race day), the hose 320 could be fully engaged with there being no chance of it separating from the helmet clip 500. When required, a backup hole 530 may be formed in the planar body 502 as illustrated to receive a cable tie 532 (also commonly referred to as a wire tie, hose tie, zap strap or zip tie). The cable tie 532 locks the hose 320 to the helmet clip 500 until it is mechanically removed (usually by cutting).

Figure 29:
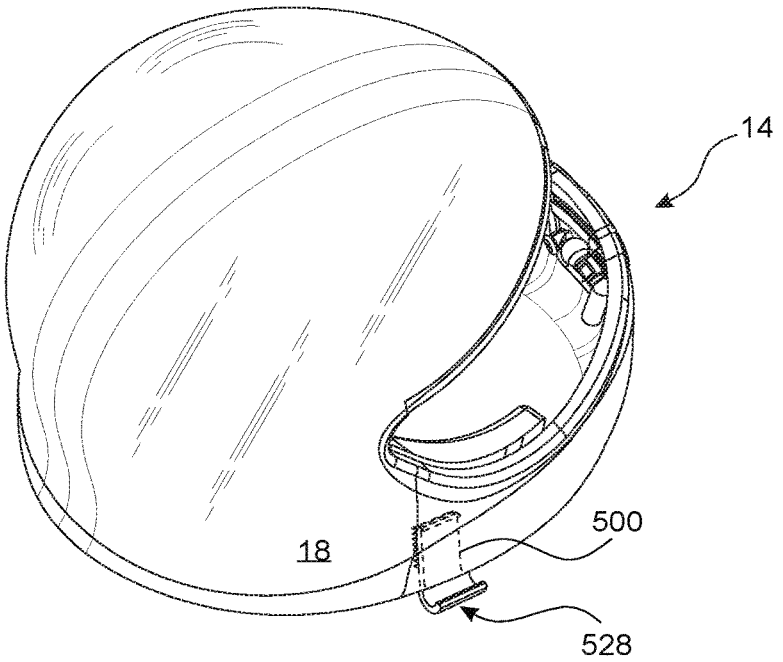
FIG. 29 is a perspective view of the helmet clip of FIG. 28 and the helmet.

With reference to FIG. 28 showing a cross-sectional view of the helmet clip 500 interfaces with a helmet 14 (as best illustrated in FIG. 29), the helmet clip 500 is retained to the helmet 14. Most helmets are provided with a foam liner (typically expanded polystyrene, EPS) and an outer shell. Helmet 14 includes a foam liner 16 and an outer shell 18 with a small amount of clearance space 20 therebetween. The helmet clip 500 may be attached to the helmet 14 by advancing the top 516 of the helmet clip 500 between the foam liner 16 and the outer shell 18 in an orientation where the back surface 506 of the planar body 502 is positioned towards the foam liner 16 and the front surface 504 is positioned towards the outer shell 18. When the helmet clip 500 slides into position, the barbs 508 (FIG. 25) generally slide against the foam liner 16. In a similar regard, the compression layer 522 (FIG. 25) generally slides against the outer shell 18. Once the helmet clip 500 is in a desired location, the foam liner 16 and outer shell 18 can be (manually) squeezed together so that the barbs 508 compress areas of the foam liner 16. After this squeezing, the helmet clip 500 is substantially attached to the helmet 14 and the hose 320 can be snapped into the hose attachment 528.

With reference to FIG. 29 showing a perspective view of the helmet clip 500 installed on the helmet 14, after installation into the helmet 14, the only visible portion of the helmet clip 500 is the hose attachment 528. It should be noted that while the figure only illustrates one helmet clip 500 being deployed, many additional helmet clips could be utilized to ideally route the hose 320 across the bottom edge of the helmet 14.

Figure 30:
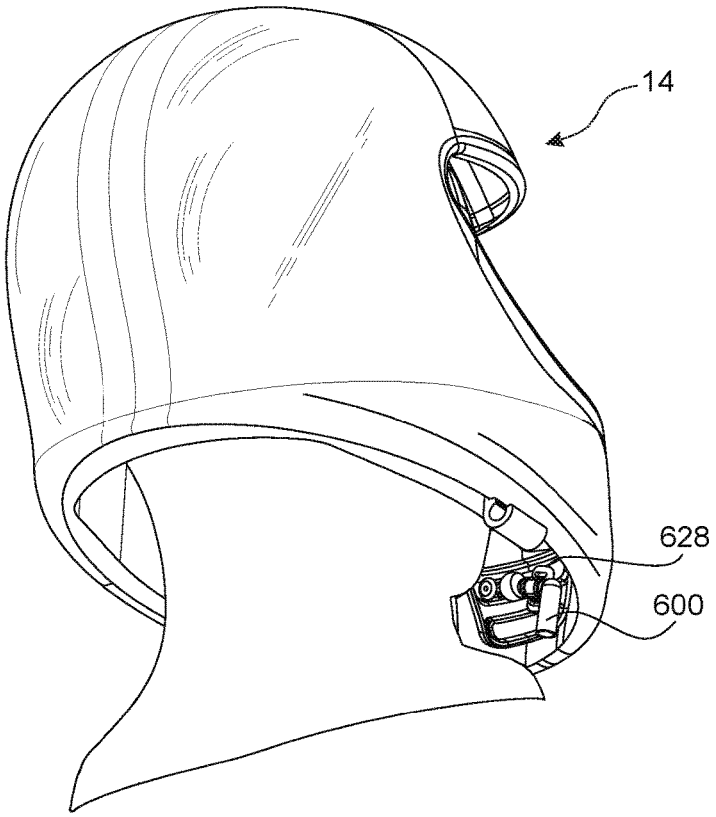
FIG. 30 is a perspective view of an illustrative helmet nozzle attached to a helmet.

With reference to FIG. 30 showing a perspective view of the helmet 14, the portable hydration system 100 may be provided with a helmet nozzle 600. The helmet nozzle 600 may be attached to the helmet in any of a variety of locations such as the illustrated mounting with the helmet nozzle 600 mounted on the inside of the helmet 14. Having provided a brief overview of where the helmet nozzle 600 may be deployed, specifics of this device will now be presented in FIGS. 31-36.

Figure 31:
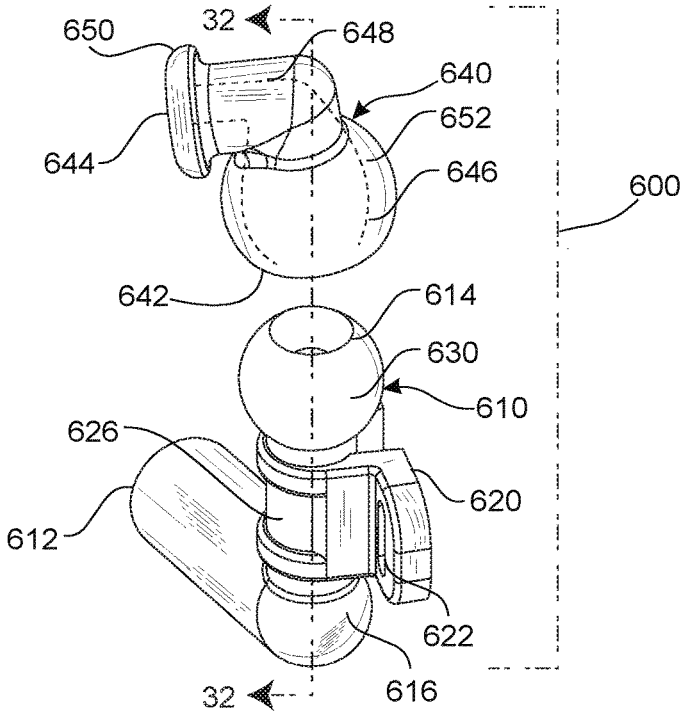
FIG. 31 is a side, exploded, view of an illustrative helmet nozzle.

With reference to FIG. 31 showing a perspective view of the helmet nozzle 600 in an exploded condition, the helmet nozzle 600 may be provided with a base 610 and a nozzle 640. The base 610 generally defines an inlet 612 and an outlet 614, the shape of the base 610 can be altered as required for different applications (e.g. a left-side mount, a right-side mount, a top-side mount, etc.). The base 610 may be any of a variety of food-safe materials such as a thermoplastic that is relatively easy to injection mold (e.g. ABS). The illustrated helmet nozzle 600 is for a right-side mount variety as illustrated best in FIG. 30 wherein the hose 320 exits the interior of the helmet 14 at the user's right side. The illustrated variant of the base 610 may be further provided with an elbow 616 formed between the inlet 612 and the outlet 614. The base 610 is also provided with an interior flow-path 618 for fluid communication from the inlet 612 and the outlet 614 of the base 610. The base 610 may be provided with a bracket 620 formed on a portion of the base 610 to assist with attaching the base 610 to the helmet 14. The bracket 620 may be formed in any of a variety of configuration, such as the illustrated strap that includes a first hole 622, a second hole 624 (FIG. 35), and a channel 626 configured to receive a cable tie. The base 610 of the helmet nozzle 600 can be attached to the helmet with a cable tie 628 (FIG. 30, also commonly referred to as a wire tie, hose tie, zap strap, or zip tie). This cable tie 628 can lock the helmet nozzle 600 to the helmet 14 until it is mechanically removed (usually by cutting). The base 610 of the helmet nozzle 600 further includes a sphere 630 formed adjacent to the outlet 614. The sphere 630 has a generally smooth surface for receiving a mating component and allowing relative movement thereto while still sealing.

With continued reference to FIG. 31, the helmet nozzle 600 further includes a nozzle 640 defining an inlet side 642 and an outlet side 644. The nozzle 640 may be made of any of a large variety of materials, however one particularly beneficial material has proven to be silicone rubber due to its ability to seal liquid, stay in an intended position, and be compliant in the event of a user's mouth impacting it. The helmet nozzle may be provided with a sphere 646, a tube 648, a bezel 650, and an interior flow-path 652. The sphere 646 is formed on the inlet side 642 of the nozzle 640 while the tube is formed between the sphere 646 and the outlet side 644. The bezel 650 is formed on the outlet side 644 of the nozzle 640 for providing an easy-to-adjust interface while the user is setting up the portable hydration system 100. When the nozzle 640 is fully installed on the base 610, the nozzle sphere 646 can spherically move relative to the base sphere 630 while maintaining a liquid-seal for liquid contained in or travelling along the base interior flow-path 618 and the nozzle interior flow-path 652. To summarize, liquid entering the base 610 at the inlet 612 can travel along the interior flow-path 618, exit the base 610 at the base outlet 614, enters the nozzle interior flow-path 652 at the nozzle inlet side 642, travel along the nozzle interior flow-path 652 through the tube 648 and exit the nozzle 640 at the outlet side 644.

Figure 32:
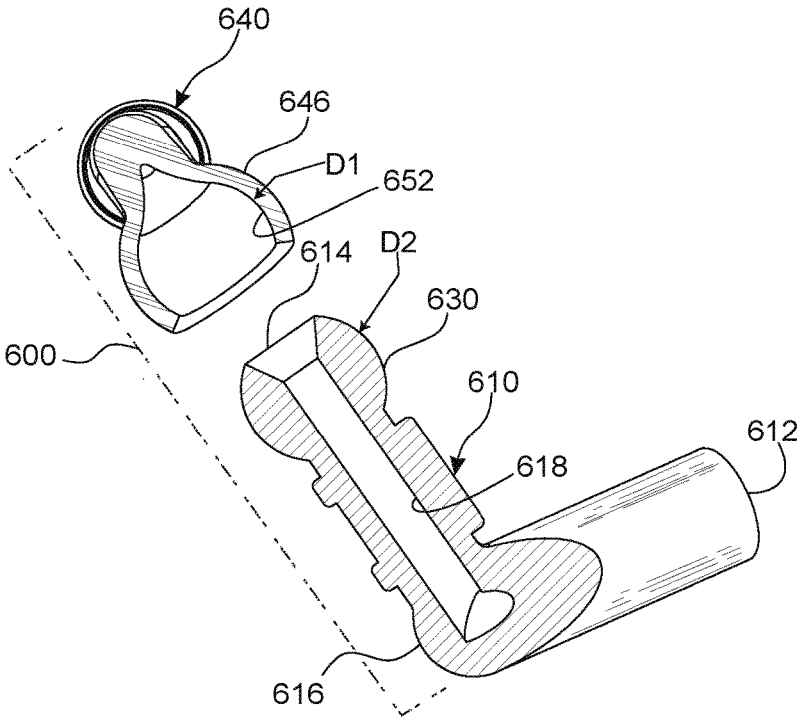
FIG. 32 is a cross-sectional view taken across plane 32-32 of the helmet nozzle of FIG. 31.

With reference to FIG. 32 showing a cross-sectional view of the helmet nozzle 600 taken across plane 32-32 (FIG. 31), the helmet nozzle 600 is designed so that the nozzle 640 snaps onto the base 610. In order to provide adequate sealing of the nozzle 640 to the base 610, the nozzle sphere 646 has a diameter D1 that may be slightly less than the diameter D2 of the base sphere 630 while in an un-installed condition so that once installed they are sealingly engaged but also readily adjustable relative to each other.

Figure 33:
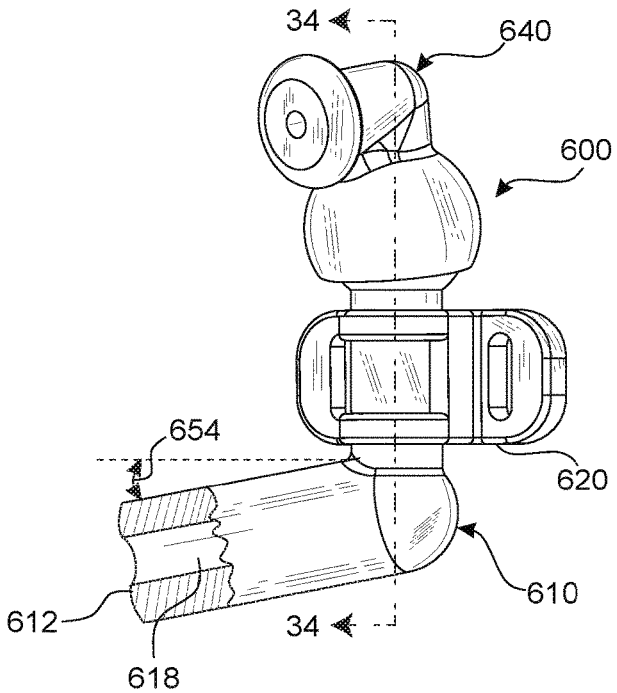
FIG. 33 is a front elevation view of the helmet nozzle of FIG. 31.

With reference to FIG. 33 showing the helmet nozzle 600, the nozzle 640 is sealingly engaged to and readily adjustable relative to the base 610. This assembly is the as-shipped device which is ready to receive a hose (e.g. hose 320) and to be attached to the helmet (e.g. helmet 14). The base 610 of the helmet nozzle 600 may be formed where the interior flow-path 618 that may be adjoining the inlet 612 is angled relatively to the bracket 620 referred to herein as pitch angle 654. While any pitch angle 645 less than ninety degrees will work, one particularly useful angle has proven to be 15 degrees, but this could be increased to 30 degrees or decreased to zero degrees.

Figure 34:
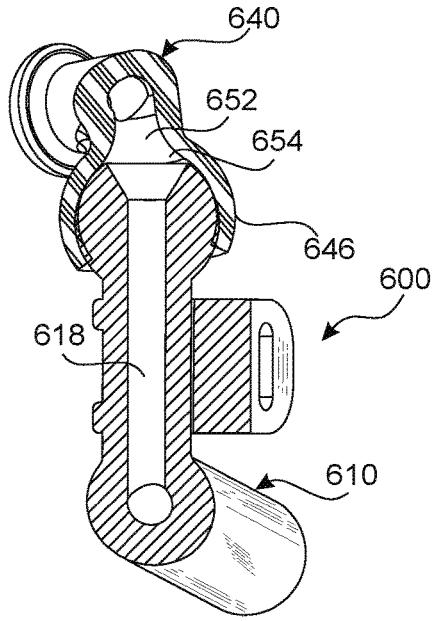
FIG. 34 is a cross-sectional view taken across plane 34-34 of the helmet nozzle of FIG. 33.

With reference to FIG. 34 showing a cross-section view of the helmet nozzle 600 taken across plane 34-34 (FIG. 33), the nozzle 640 is fully adjustable relative to the base 610 due to a hollow over-center sphere 654 formed co-spherically to the sphere 646. When adjusting the nozzle 640, the interior flow-path 652 of the nozzle 640 is in fluid communication with the interior flow-path 618 of the base 610.

Figure 35:
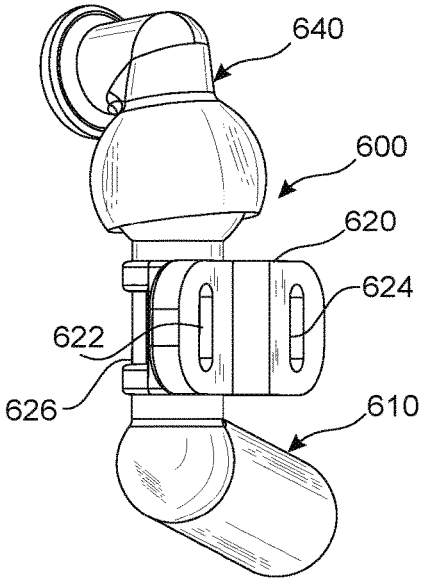
FIG. 35 is a back elevation view of the helmet nozzle of FIG. 31.

With reference to FIG. 35 showing a side elevation view of the helmet nozzle 600, the base 610 may be provided with the first hole 622 and the second hole 624 formed in the bracket 620.

Figure 36:
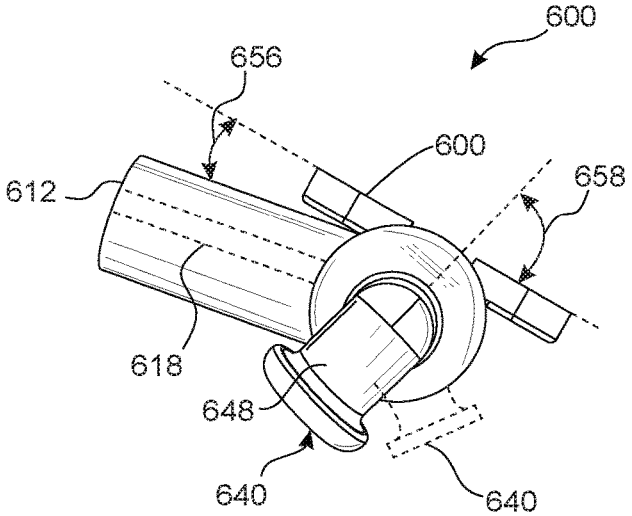
FIG. 36 is a top plan view of the helmet nozzle of FIG. 31.

With reference to FIG. 36 showing a top plan vie of the helmet nozzle 600, the base 610 of the helmet nozzle 600 may be formed where the interior flow-path 618 that is adjoining the inlet 612 is angled relatively to the bracket 620 referred to herein as an attack angle 656. While any attack angle 656 less than ninety degrees will work, one particularly useful angle has proven to be 15 degrees, but this could be increased to 30 degrees or decreased to zero degrees. The nozzle 640 is shown in a first condition wherein the tube 648 is at a spray angle 658 relative to the bracket 620. Also shown in FIG. 36 is a dashed-line position for the nozzle 640 that in a second condition that is different than the first condition since spray angle 658 has changed relative to bracket 620.

With reference to FIG. 37 showing a perspective view of a motorsports handlebar actuator 700 provided for wirelessly communicating with other components of the portable hydration system 100, specifically the electronics package 250 (FIG. 3) of the pump assembly 200 (FIG. 3). The motorsports handlebar actuator 700 generally defines top 702, a bottom 704, a front 706, a back 708, a left 710 and a right 712 that are used for describing orientation of various components of the motorsports handlebar actuator 700. The motorsports handlebar actuator 700 is provided with a housing 720, a bar clamp 740, a cap 750, a lever 760, an electronics assembly 770 (FIG. 38), and a battery 800 (FIG. 38).

With reference to FIG. 38 showing a perspective view of the actuator 700 in an exploded condition, the actuator 700 may be any of a number of devices, instructions, actions, or the like for delivering water to the user. While the present description is directed to mounting the actuator 700 on the vehicle 10, the present portable hydration system 100 may be utilized in a number of situations ranging from gamers engrossed in online gaming, to military applications, and all varieties of applications where a user needs to be hydrated. In one case, the actuator 700 may be configured as a finger-actuated device commonly referred to as a trigger. When configured as a finger or thumb activated device, actuator 700 may be attached to a motorsports handlebar and therefor, actuator 700 may be referred to as a motorsports handlebar actuator 700.

In this illustrative example, the motorsports handlebar actuator 700 includes the housing 720 is configured with a vehicle attachment such as the illustrated bar cutout 722 formed on the housing 720 near the bottom 704. In the illustrated example of attaching the motorsports handlebar actuator 700 to a vehicle 10, the motorsports handlebar actuator 700 also include a bar clamp 740 provided clamping on a round tube of handlebars. The bar clamp 740 is attached to the housing 720 via a fasteners 732,734. The housing 720 may be provided with a lever pivot 724, a spring post 726, an electronics pocket 728, and at least one cap clip 730. The lever pivot 724 is formed in the housing 720 for supporting a lever pin 736. The spring post 726 is formed in the housing 720 for supporting a lever spring 738. The electronics pocket 728 is formed in the housing 720 as a deep pocket for receiving the electronics assembly 770 as illustrated. The cap clip 730 is formed in the housing 720 for receiving the cap 750.

With continued reference to FIG. 38, the cap 750 is a thin-walled structure provided with a clip slot 752 formed to receive the cap clip 730 of the housing 720. The cap 750 may further include a plurality of openings 754 to receive various components of the electronics assembly 770. The motorsports handlebar actuator 700 may also include the lever 760 that includes a lever pivot 762. The lever pivot 762 of the lever 760 is captured by the lever pin 736 as illustrated to enable the lever to be captured by and rotatably mounted to the housing 720. The captured lever 760 is biased toward the top 702 of the housing by the lever spring 738.

With continued reference to FIG. 38, the motorsports handlebar actuator 700 further includes an electronics assembly 770 having a bulkhead structure referred to as a printed circuit board (PCB) 772. The printed circuit board (PCB) 772 generally defines a first surface 774 and an oppositely disposed second surface 776. The first surface 774 may have a battery holder 778 attached thereto. One illustrative type of battery holder 778 is known as a coin-cell holder for receiving a planar-battery known as a coin-cell. The electronics assembly 770 may further include a mode switch 780, a first indicator 782, a second indicator 784, a third indicator 786, and a fourth indicator 788. The indicators 782,784,786,788 and mode switch 780 may be located on the first surface 774 of the printed circuit board (PCB) 772 or on a daughterboard that is commonly used in by those skilled in the art. The mode switch 780 is activated by the user to initiate a variety of power states and/or operational conditions indicated by the indicators 782,784,786 and 788. One mode invoked by the mode switch 780 may be pairing the motorsports handlebar actuator 700 with the pump assembly 200, another mode may be manual-hydration wherein the motorsports handlebar actuator 700 invokes the pump assembly 200 to supply liquid continuously, another mode may be delayed-start of the delivery of liquid, and another might be time-monitored delivery of liquid. These modes are meant to be examples of how the indicators 782,784,786 and 788 and the mode switch 780 are utilized to adjust parameters/conditions of the portable hydration system 100.

With reference to FIG. 39 showing a perspective view of the electronics assembly 770, specifically the second surface 776 of the printed circuit board (PCB) 772, the electronics assembly 770 may be provided with a large variety of components to cause proper operation of the motorsports handlebar actuator 700 as well as the larger portable hydration system 100, however three noteworthy components are an actuator transceiver 790, an actuator antenna 792 and a lever switch 794 (FIG. 38). The actuator transceiver 790 may be provided for creating signals that communicate with a similar transceiver 260 (FIG. 3) included with the pump assembly 200 (FIG. 3). The actuator transceiver 790 generates a signal, which is presented to the actuator antenna 792 for communicating to/from other transceivers such as the transceiver 260 in the pump assembly 200. The lever switch 794 may be attached anywhere on the electronics assembly 770, such as the illustrated thru-hole attachment on the second surface 776 of the printed circuit board (PCB) 772.

The lever switch 794 generally defines a switch axis 798 (FIG. 38) that may be coaxial to the direction of operation of the lever switch 794.

With reference again to FIG. 38, the motorsports handlebar actuator 700 is further provided with an actuator power supply, such as the illustrated planar battery 800. The planar battery 800 includes a first contact 802, a second contact 804, and a perimeter 806. The first contact 802 and second contact 804 are generally parallel to each other and offset by a battery thickness. The two contacts 802,804 are separated by the battery perimeter 806. The perimeter 806 generally defines a battery diameter that is greater than the battery thickness. In practice, the planar battery 800 can be slid into the battery holder 778 such that the second contact 804 of the planar battery 800 contacts the battery holder 778 while the first contact 802 of the planar battery 800 contacts a portion of the first surface 774 of the printed circuit board (PCB) 772. This places the planar battery 800 into electrical communication with the electronics assembly 770 whereby the planar battery 800 provides energy to the electronics assembly 770.

With continued reference again to FIG. 39, the printed circuit board (PCB) 772 may be configured with a finger cutout 796. The finger cutout 796 is only large enough to receive the fingernail of the user for changing the 800. This configuration might seem elementary, however it has proven to be useful since the planar battery 800 can attached to the electronics assembly 770 and removed without the use of tools and without loss of valuable space (as the handlebars of motorsports vehicles tend to be very crowded).

Figure 40:
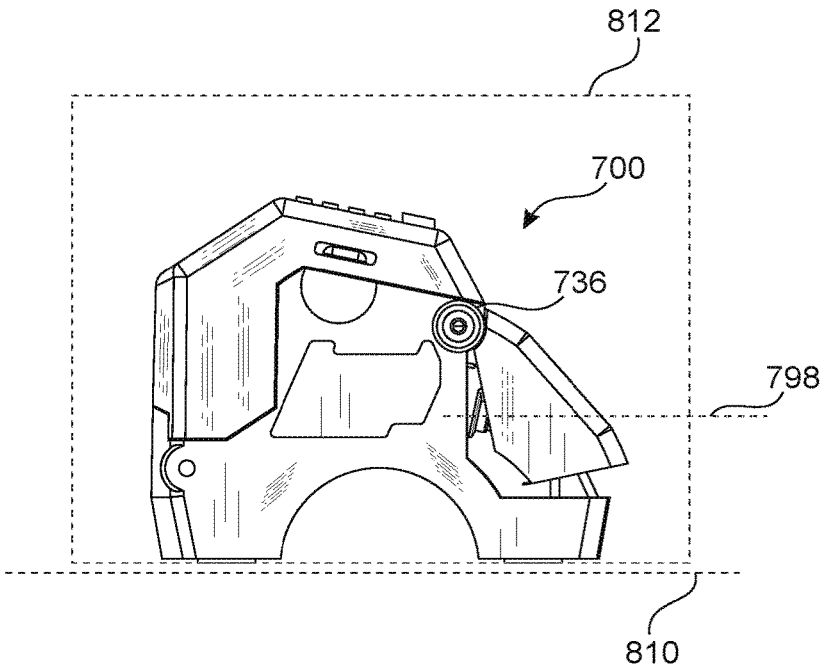
FIG. 40 is a side elevation view of the actuator of FIG. 37.
Figure 41:
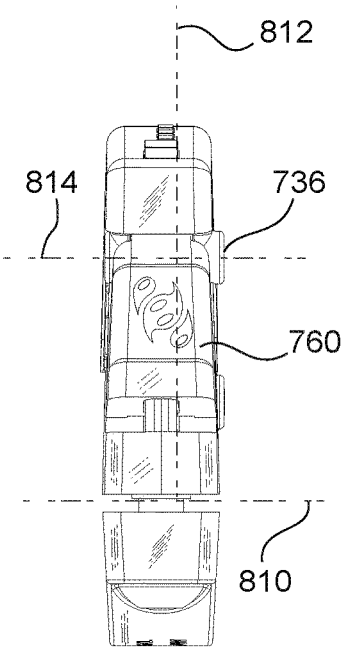
FIG. 41 is a front elevation view of the actuator of FIG. 37.

With reference to FIG. 40 showing a side elevation view of the motorsports handlebar actuator 700, the bottom 704 of the motorsports handlebar actuator 700 defines an attachment-plane 810. The second surface 776 (FIG. 38) of the printed circuit board (PCB) 772 (FIG. 38) has a coplanar PCB-plane 812, the PCB-plane 812 intersects the attachment-plane 810 along a line and the two planes intersect at a ninety degree angle as best illustrated in FIG. 41. With continued reference to FIG. 40, the switch-axis 798 is parallel to the attachment-plane 810 and parallel to the PCB-plane 812.

With reference to FIG. 41 showing a front elevation view of the motorsports handlebar actuator 700, the motorsports handlebar actuator 700 may also include a lever-axis 814 that is coaxial to the lever pin 736. The lever-axis 814 may be parallel to the attachment-plane 810 and serves as the axis about which the lever 760 rotates. In practice, the user pushes on the lever 760 to cause rotational movement of the lever 760 which pushes the lever switch 794.

Figure 42:
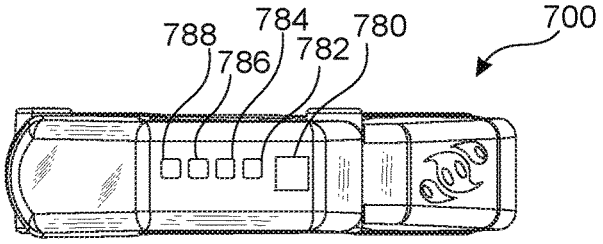
FIG. 42 is a top plan view of the actuator of FIG. 37.

With reference to FIG. 42 showing a top plan view of the motorsports handlebar actuator 700, the mode switch 780, first indicator 782, second indicator 784, third indicator 786, and fourth indicator 788 are used manipulate various modes of the motorsports handlebar actuator 700 and the larger portable hydration system 100.

With reference to FIG. 43 showing a side elevation view of a liquid bladder 900, the liquid bladder 900 may be similar to, or a variant of, the liquid container 110 (FIG. 2). There are some differences between the liquid bladder 900 and the liquid container 110, specifically the exit port 132 (FIG. 2) is rotated 180 degrees and other novel features are provided. The liquid bladder 900 generally defines a top 902, a bottom 904, a left side 906, a right side 908, a front 910, and a back 912. The top 902, bottom 904, left side 906, and right side 908 generally create a walled perimeter that support the front 910 and the back 912 in a manner that defines an interior portion 914 that is separated from an exterior portion 916. The top 902, bottom 904, left side 906, right side 908, front 910, and back 912 are typically formed out of a rubber or flexible material (e.g. thermoplastic urethane). The various panels of material are welded together in a manner well known to those skilled in the art to create a vessel where liquid is contained in the interior portion 914 and not inadvertently leak to the exterior portion 916. The liquid bladder 900 is further provided with a filling cap 920 and an exit port 930. The filling cap 920 may be provided for filling liquid from the exterior portion 916 to the interior portion 914. The exit port 930 is provided for releasing liquid from the exterior portion 916 to the exterior portion 916. The exit port 930 is different than those found on commercially available liquid bladders in that it is rotated 180 degrees, so it is facing in a downward position wherein liquid is ejected from the exit port 930 towards the bottom 904. When provided in this configuration, the exit port 930 is located at the bottom-most position on the front 910 relatively close to the bottom 904 where it reduces the propensity for 'air locking' a pump.

With continued reference to FIG. 43, the liquid bladder 900 may further include a motor pocket 940 formed as illustrated near the left side 906 and the bottom 904 for receiving a pump assembly 950. In one example, the motor pocket 940 is made of the same material as other components of the liquid bladder 900 but provides a support structure for receiving the pump assembly 950. If the exit port 930 and motor pocket 940 are formed as illustrated, an intake 952 of the pump assembly 950 requires a different geometry (as illustrated). The illustrated geometry of the pump assembly 950, the intake 952 and the exit port 930 results in a pump (located inside the pump assembly 950) to always have water which aids in user experience as the pump can move liquid without priming.

The liquid bladder 900 may be further provided with a channel for routing the line-set 300 (FIG. 10). For example, the liquid bladder 900 may include a right channel 960 and/or a left channel 970. The right channel 960 may be a piece of material partially attached to the front 910 in a manner that creates a pathway for receiving the line-set 300. The right channel 960 may generally define an intake 962 and an oppositely disposed exit 964. When installing the line-set 300 into the right channel 960, the distal end 304 (FIG. 10) of the line-set 300 is advanced past the intake 962 and ultimately exists from the right channel 960 at the exit 964. This right channel 960 enables the line-set 300 to be routed in an organized and self-priming manner without allowing the line-set 300 to kink. In a similar manner, if a user would prefer to route the line-set 300 to their left shoulder, the user could utilize the left channel 970 in a similar manner as described for the right channel 960. The liquid bladder 900 may also include a hook 980 formed on the top 902 of the liquid bladder 900. If provided with the hook 980, the hook 980 is useful for supporting the liquid bladder 900 when inserted in a sleeve formed in a piece of clothing or a backpack to keep the liquid bladder 900 from simply piling up near the bottom 904.

With continued reference to FIG. 43, in one alternative, the liquid bladder 900 may contain the liquid 912 with a fluid 990 (most likely air). In this alternative, the bladder 900 expands to a maximum where the fluid 990 has a pressure greater than atmospheric pressure. The fluid 990 may be pressurized by a fluid valve 992, such as the illustrated valve that are commonly used to fill air into tires. In this alternative, a pump assembly may compress fluid that is introduced to the liquid bladder 900 via the fluid valve 992. Subsequently, liquid 912 is forced out of the exit port 930 and, optionally, directly into a hose provided for conveying fluid to the user.

In one alternative, the liquid container 110 may be inserted into a fabric enclosure such as a sleeve stitched into a jacket or a backpack. With reference to FIG. 1, the user 12 is typically wearing a jacket 30 and/or a backpack 40. The description of a jacket 30 will now be provided, wherein the jacket 30 is provided with a fabric enclosure 32 formed on the jacket 30. The fabric enclosure 32 serves as a pocket for receiving the liquid container 110, the pump assembly 200, and a portion of the line-set 300. In another variant, the backpack 40 may be worn by the user 12 wherein the backpack serves as a removable fabric enclosure for supporting the liquid container 110, the pump assembly 200, and a portion of the line-set 300. The backpack 40 includes at least one strap 42 for securing the backpack 40 over a shoulder of the user 12. The backpack 40 generally defines a back portion 44 and a front portion 46 wherein the liquid container 110 is located in the back portion 44 and the pump antenna 350 is located in the front portion 42.

In an another alternative illustrated in FIG. 3, the pump power supply (illustrated as battery 262) may be positioned inside the pump assembly 200. In use, the main enclosure 210 of the pump assembly 200 is formed with a battery cavity 263 substantially similar to the electronics cavity 242 and the pump cavity 240. While any of a variety of holding mechanisms may be utilized, in one example the pump assembly 200 is held into the pump cavity 240 by hook-and-loop fastener(s).

In an alternative illustrated in FIG. 6, grease 270 may be utilized to block encapsulation from the indicator 254 and switch 256 as best illustrated in the breakaway section of FIG. 6. If grease 270 is utilized, it is distributed by a syringe into the bottom portion of the electronics cavity 242 (FIG. 3) before the encapsulant is distributed into the electronics cavity 242. This enables the indicator 254 to continue to work without being covered by the encapsulant.

In one alternative, the actuator 700 may be any of a variety of types of initiators. For example, actuator 700 may be configured as shown as a motorsports handlebar actuator 700, or actuator 700 may be capacitive touch, voice activated, interval activated, geo-location activated, user-bio activated (wherein a sensor detects a low water level), foot actuated, or any of a large variety of switches, triggers, sensors, camera, computer instructions, or the like. In one illustration, the actuator 700 may include a microphone near the mouth of a user, the microphone capable of detecting audible instructions (e.g. saying 'Give me water') and invoking a liquid delivery process. Another illustrative example is visually monitoring the user's mouth for a period of time when the user indicates the need for water (e.g. opening their mouth for 3 seconds) and then activating the liquid delivery.

In another alternative, the helmet nozzle 600 may include a recessed hole formed in the outlet side 644 for receiving a tube. When provided with the tube, the helmet nozzle 600 is configured at a relatively far distance from the user's mouth and liquid is directed by the provided tube.

While the above description includes terms such as top, bottom, left, right, inside, outside, front, back, and other descriptors regarding physical orientation and/or position, it is to be understood that these are provided for illustrative purposes only. However, the present description was provided to convey to one skilled in the art.

While the principles of the disclosure have been described above in connection with the specific apparatuses and methods, it is to be understood that this description is made only by way of example and not as limitation on the scope of the disclosure.

VARIOUS NOTES AND EXAMPLES

LINE-SET FOR PORTABLE HYDRATION SYSTEM: FIG. 2 A portably hydration system including a line-set for communicating and various components are disclosed. The system utilizes a pump to transfer potable liquid (e.g. water) from a liquid container to a user during challenging activities (e.g. endurance motorcycle riding).

HOSE COUPLER FOR A LIQUID FLOW: FIG. 17 A hose coupler for connecting two hoses is disclosed. The hose coupler is useful for various liquid transmission applications such as a portable hydration system used during challenging activities (e.g. endurance motorcycle riding).

CLIP FOR ATTACHING ACCESSORIES TO A HELMET: FIG. 28 A clip used to attach various items to a helmet by sliding a planar body between a shell and a liner of the helmet. One illustrative application is attaching a hose to helmet.

NOZZLE FOR HYDRATION: FIG. 33 An adjustable liquid delivery nozzle used to eject water from a pressurized liquid delivery system. One illustrative application is using the nozzle for hydrating a user.

Example 1 is a portable hydration system comprising: a liquid container operably attached to a user, the liquid container comprising: a liquid outlet; a pump assembly in fluid communication with the liquid container, the pump assembly comprising: a pump; a fluid inlet in fluid communication with the liquid container and the pump; an electronics package in electrical communication with the pump, the electronics package comprising: a pump transceiver operable to wirelessly communicate; and a pump power supply in electrical communication with the pump and the electronics package; an actuator operable to initiate liquid flow, the actuator comprising: an actuator transceiver operable to wirelessly communicate with the pump transceiver; an actuator antenna in electrical communication with the actuator transceiver; and an actuator power supply that is different than the pump power supply; a line-set comprising: a hose defining a proximal end in fluid communication with the liquid outlet of the liquid container and an oppositely disposed distal end operable to deliver liquid to a mouth of the user; a cable defining a proximal end in electrical communication with the pump transceiver and an oppositely disposed distal end attached to the hose; and a pump antenna attached to the distal end of the cable and operable to wirelessly communicate with the actuator antenna.

In Example 2, the subject matter of Example 1 includes, wherein the liquid outlet of the liquid container is attached to the fluid inlet of the pump.

In Example 3, the subject matter of Examples 1-2 includes, and further comprising: a pouch attached to the user; wherein the liquid container, the pump assembly, and the proximal end of the hose are inside the pouch; and wherein the pump antenna is outside of the pouch.

In Example 4, the subject matter of Examples 2-3 includes, and further comprising: a shoulder strap formed on the pouch operable to support the pouch on the user; and wherein the line-set is attached to the shoulder strap.

In Example 5, the subject matter of Examples 1-4 includes, wherein: the line-set further comprises: a line-set length defined by an elongated distance between a line-set proximal end and a line-set distal end; an intermediate-point that is one-third of the line-set length wherein the line-set proximal end and two-thirds of the line-set length from the line-set distal end; a proximal-third of the line-set located between the line-set proximal end and the intermediate-point; and a distal-majority of the line-set located between the intermediate-point and the line-set distal end; and wherein the pump antenna is located in the line-set distal-majority.

In Example 6, the subject matter of Example 5 includes, wherein the line-set length is between eight and forty-eight inches.

In Example 7, the subject matter of Examples 1-6 includes, wherein the liquid inlet of the pump assembly is adjoining the liquid container.

In Example 8, the subject matter of Examples 1-7 includes, and further comprising: a vehicle mount formed on the actuator, the vehicle mount operable to attach the actuator to a vehicle.

In Example 9, the subject matter of Examples 1-8 includes, the cable further comprising: a signal conductor in electrical communication with the pump transceiver and the pump antenna; a dielectric layer coaxially encapsulating and adjacent to the signal conductor;

and a shield coaxially encapsulating and adjacent to the dielectric layer.

In Example 10, the subject matter of Examples 1-9 includes, wherein the electronics package is disposed inside the pump assembly.

In Example 11, the subject matter of Examples 1-10 includes, wherein the liquid container is a hydration bladder.

In Example 12, the subject matter of Examples 1-11 includes, and further comprising: a hose clip operably attaching the line-set to a helmet, the hose clip comprising: a planar body operable to attached to the helmet; and a clip portion adjacent to the planar portion operable to support the hose of the line-set.

In Example 13, the subject matter of Examples 1-12 includes, and further comprising: a nozzle attached to the distal end of the hose; and wherein the nozzle is in fluid communication with the liquid container via the line-set and the pump assembly.

In Example 14, the subject matter of Examples 1-13 includes, wherein the pump power supply is a stand-alone battery.

In Example 15, the subject matter of Examples 1-14 includes, and further comprising: a hose coupler positioned inline of the hose of the line-set.

In Example 16, the subject matter of Example 15 includes, wherein the hose coupler is positioned in a distal-half of the line-set.

Example 17 is a method of hydrating a user comprising: providing a liquid container operable to attach to the user; providing a pump assembly in fluid communication with the liquid container; the pump assembly comprising: a pump; an electronics package in electrical communication with the pump; and a pump transceiver operable to communicate wirelessly; providing a line-set defining a proximal end attached to the pump assembly and an oppositely disposed distal end operable to deliver liquid to a mouth of the user; the line-set comprising: a hose for conveying liquid from the liquid container to the user via the pump; a cable defining a proximal end attached to the pump transceiver and an oppositely disposed distal end; and a pump antenna attached to the distal end of the cable; providing an actuator operable to user-initiate liquid flow, the actuator comprising: an actuator transceiver for wirelessly communicating with the electronics package via the pump transceiver; and an actuator antenna in electrical communication with the actuator transceiver; wherein the providing the actuator antenna defines:

a transmission vector extending between the actuator antenna and the pump antenna; and positioning the pump antenna for communicating wirelessly with the actuator transceiver via the actuator antenna; the actuator antenna supported line-set between the proximal and distal ends of the line-set, wherein the transmission vector is unobstructed by the user and the liquid container; transferring signals between the actuator antenna and the electronics package via the pump antenna; and activating, in response to the transferring signals, the pump to convey liquid from the liquid container to the mouth of the user via the hose thereby hydrating the user.

In Example 18, the subject matter of Example 17 includes, installing, after providing the liquid container, the liquid container into a fabric enclosure operable to removably attach the liquid container to the user.

In Example 19, the subject matter of Examples 17-18 includes, and further comprising: attaching, the actuator to a vehicle.

In Example 20, the subject matter of Examples 17-19 includes, wherein the positioning the pump antenna includes placing the pump antenna adjacent to a shoulder of the user.

In Example 21, the subject matter of Examples 17-20 includes, and further comprising: providing a hose coupler comprising: an enclosure attached to the hose between a line-set midpoint and the distal end of the line-set; and a breakaway attached to the hose between the enclosure and the distal end of the line-set; and fastening the breakaway to the enclosure to establish fluid communication between the liquid container and the user via the hose, the hose coupler, and the distal end of the line-set.

In Example 22, the subject matter of Example 21 includes, and further comprising: providing a hose clip; attaching the hose clip to a helmet; and attaching the line-set to the hose clip between the breakaway and the distal end of the line-set.

In Example 23, the subject matter of Example 22 includes, and further comprising: squeezing the helmet adjacent to the hose clip.

Example 24 is a motorsports handlebar actuator comprising: a housing defining an attachment-plane, the housing protruding from the attachment-plane; a printed circuit board (PCB) adjoining the actuator housing, the printed circuit board defining a PCB-plane that is perpendicular to the attachment-plane; a planar battery adjacent to a portion of the printed circuit board, the planar battery comprising: a thickness; and a diameter that is greater than the thickness; and a battery-plane adjoining a surface of the planar battery, and the battery-plane is parallel to the PCB-plane; and a switch electrically interfaced with a portion of the printed circuit board, the switch defining a switch-axis that is parallel to the PCB-plane and the battery-plane.

In Example 25, the subject matter of Example 24 includes, and further comprising: a battery holder electrically interfaced with a portion of the printed circuit board; a first contact formed on the planar battery, the first contact slidably interfaces with the battery holder; and a second contact formed on the planar battery, the second contact slidably interfaces with the printed circuit board.

In Example 26, the subject matter of Examples 24-25 includes, wherein the planar battery defines a perimeter coincident with the diameter; and the printed circuit board further comprises: a finger cutout formed in the printed circuit board, the finger cutout adjacent to the planar battery perimeter at two location.

In Example 27, the subject matter of Examples 24-26 includes, and further comprising: a lever rotatably attached to the actuator housing, the lever being co-axial to a lever-axis; the lever defining a lever-angle; and the lever-axis is parallel to the actuator-axis; wherein the lever further comprises: a pad formed on the lever, the pad is adjacent to and in contact with the switch; a first condition wherein the lever-angle is at a first angle and the switch is at a first position; and a second condition wherein the lever-angle is at a second angle and the switch is at a second position different than the first position.

Example 28 is a hose coupler comprising: an enclosure defining an inlet end and an oppositely disposed outlet end; the enclosure further defining an interior portion and an exterior portion, the enclosure comprising: a backflow prevention valve positioned in the interior adjacent to the inlet end; a containment valve positioned between the backflow prevention valve and the outlet end; a fastener side-A formed on the enclosure; a hose interface formed on the enclosure exterior portion at the inlet end, the hose interface further comprises an interior flow-path that is in fluid communication with the enclosure interior portion; a breakaway comprising: a tube defining an inlet end and an oppositely disposed outlet end; the tube further defining an interior portion and an exterior portion; a hose interface formed on the tube exterior portion at the tube proximal end; a ramp formed on the tube exterior portion at the tube distal end; a fastener side-B formed on the tube exterior portion; a uni-directional condition wherein: the breakaway is adjoining the enclosure, the breakaway ramp is adjoining the containment valve, and wherein there is a flow-path from the enclosure inlet end to the breakaway outlet end; and an anti-directional condition wherein: the breakaway is separated from the enclosure, and wherein there is no flow-path between the enclosure inlet end and enclosure outlet end.

In Example 29, the subject matter of Example 28 includes, and further comprising: an umbrella valve in the backflow prevention valve.

In Example 30, the subject matter of Examples 28-29 includes, and further comprising: a duckbill valve in the containment valve, the duckbill valve comprising: a brim defining a top surface and an oppositely disposed bottom surface; a cap formed on the brim bottom surface, the cap defining a bottom surface that is oppositely disposed from the brim top surface; a blind hole defining an interior wall formed in the brim and the cap starting at the brim top surface and extending towards the cap bottom surface; and a cut formed in the cap that extends from the cap bottom surface to the blind hole interior wall.

In Example 31, the subject matter of Examples 28-30 includes, and further comprising: at least one barb formed on the hose interface.

In Example 32, the subject matter of Examples 28-31 includes, wherein: the backflow prevention valve and the containment valve are elastomeric material.

In Example 33, the subject matter of Examples 28-32 includes, wherein fastener side-A and fastener side-B are selected from a group of fasteners consisting of: hook-and-loop material, at least one cantilevered detent, a magnet-and-iron pair, a N/S magnet pair, and a thread.

In Example 34, the subject matter of Examples 28-33 includes, wherein the fastener side-A or fastener side-B is a magnet.

In Example 35, the subject matter of Examples 28-34 includes, wherein both of the fastener side-A and fastener side-B are magnets.

In Example 36, the subject matter of Examples 28-35 includes, wherein both of the fastener side-A and fastener side-B are ring magnets.

In Example 37, the subject matter of Examples 28-36 includes, wherein the hose interface contains at least one barb.

In Example 38, the subject matter of Examples 28-37 includes, wherein the enclosure and the breakaway comprise ramps that cooperate to axially move the breakaway away from the enclosure.

Example 39 is a method of containing liquid in a releasable hose, the method comprising: providing a supply tube defining an inlet and an outlet, the inlet interfaced to liquid supply; providing an enclosure attached to the supply tube outlet, the enclosure defining an inlet end and an oppositely disposed outlet end; the enclosure further defining an interior portion and an exterior portion, the enclosure comprising: a backflow prevention valve positioned in the interior adjacent to the inlet end; a containment valve positioned between the backflow prevention valve and the outlet end; a fastener side-A formed on the enclosure; a hose interface formed on the enclosure exterior portion at the inlet end, the hose interface further comprises an interior flow-path that is in fluid communication with the enclosure interior portion; providing a breakaway releasably attachable to the enclosure, the breakaway comprising: a tube defining an inlet end and an oppositely disposed outlet end, the tube further defining an interior portion and an exterior portion; a hose interface formed on the tube exterior portion at the tube proximal end; a ramp formed on the tube exterior portion at the tube distal end; a fastener side-B formed on the tube exterior portion; providing a distribution tube attached to the breakaway hose interface; attaching the breakaway to the enclosure, wherein the attaching bypasses the containment seal; biasing the containment seal in response to the attaching the breakaway; detaching the breakaway from the enclosure, wherein the detaching restores the containment seal; and containing liquid as a result of the detaching the breakaway.

Example 40 is a hose clip comprising: a planar body defining a front surface and an oppositely disposed back surface, the planar body defining a top edge and an oppositely disposed bottom edge that cooperate to separate the planar body front surface from the planar body back surface; a barb formed on the planar body back surface adjacent to the planar body top edge; and a hose attachment formed on the planar body bottom edge.

In Example 41, the subject matter of Example 40 includes, wherein the hose attachment comprises circular portion.

In Example 42, the subject matter of Examples 40-41 includes, wherein the hose attachment circular portion includes a diameter that is equal to a hose diameter.

In Example 43, the subject matter of Examples 40-42 includes, and further comprising: a compressible sheet adjoining the planar body front surface.

In Example 44, the subject matter of Examples 40-43 includes, and further comprising: a second barb formed on the back surface of the planar body.

Example 45 is a method of attaching a hose to a helmet, the method comprising: providing a hose clip comprising: a planar body defining a front surface and an oppositely disposed back surface, the planar body defining a top edge and an oppositely disposed bottom edge that cooperate to separate the planar body front surface from the planar body back surface; a friction-bearing layer formed on the planar body back surface adjacent to the planar body top edge; and a hose attachment formed on the planar body bottom edge; sliding the hose clip between a shell and a foam liner of the helmet whereby the friction-bearing layer engages the helmet foam liner and is urged into position from a force imparted by the helmet shell; and attaching the hose to the hose attachment.

Example 46 is a hydration nozzle comprising: a base comprising: an inlet tube; a sphere formed on the inlet tube; and a liquid path formed from the inlet tube to through the sphere; a nozzle removably attached to the sphere, the nozzle comprising: a hollow over-center sphere, wherein the hollow over-center sphere is sealingly attached to the sphere of the base; an exit hole formed in the nozzle; and a flow path formed from the hollow over-center sphere to the exit hole.

In Example 47, the subject matter of Example 46 includes, and further comprising: a bracket formed on the base; at least one hole formed in the bracket; and whereby the base is fixedly attached to a helmet at the bracket hole.

Example 48 is at least one machine-readable medium including instructions that, when executed by processing circuitry, cause the processing circuitry to perform operations to implement of any of Examples 1-47.

Example 49 is an apparatus comprising means to implement of any of Examples 1-47.

Example 50 is a system to implement of any of Examples 1-47.

Example 51 is a method to implement of any of Examples 1-47.

What is claimed is:

1. A portable hydration system comprising:
- a liquid container, the liquid container comprising:
  - a liquid outlet;
- a pump assembly in fluid communication with the liquid container, the pump assembly comprising:
  - a pump; and
  - a fluid inlet in fluid communication with the liquid container and the pump;
- an electronics package in electrical communication with the pump, the electronics package comprising:
  - a pump power supply in electrical communication with the pump and the electronics package;
- an actuator operable to initiate liquid flow, the actuator configured to communicate with the pump via the electronics package;
- a hose defining a proximal end in fluid communication with the liquid outlet of the liquid container and an oppositely disposed distal end operable to deliver the liquid to a mouth of a user;
- a hydration nozzle comprising:
  - a base configured to attach to a helmet comprising:
    - an inlet tube attached to the distal end of the hose;
    - a base sphere formed on the inlet tube; and
    - a liquid path formed between the inlet tube and through the base sphere;
  - a nozzle removably attached to the base sphere, the nozzle comprising:
    - a hollow sphere removably attached to the base sphere;
    - an exit hole formed in the nozzle; and
    - a flow path formed from the hollow sphere to the exit hole.

2. The portable hydration system of claim 1 and further comprising:
- a base diameter of the base sphere;
- a nozzle diameter of the hollow sphere;
- an un-installed condition wherein the nozzle diameter is less than the base diameter; and
- an installed condition wherein the nozzle diameter is the base diameter and the nozzle is sealingly engaged to, and readily adjustable relative to, the base.

3. The portable hydration system of claim 1 wherein the nozzle is made of a compliant material.

4. The portable hydration system of claim 1 wherein the nozzle is made of silicone rubber.

5. The portable hydration system of claim 1 and further comprising:
- a bracket formed on the base configured to attach the base to the helmet.

6. The portable hydration system of claim 5 and further comprising:
- at least one hole formed in the bracket, the hole configured to receive a fastener.

7. The portable hydration system of claim 5 and further comprising:
- a channel formed on the bracket, the channel configured to receive a cable tie.

8. The portable hydration system of claim 1 and further comprising:
- a tube adjoining the exit hole.

9. The portable hydration system of claim 1 and further comprising:
- a bezel formed on the nozzle at an outlet side of the nozzle.

10. A method of adjusting a hydration spray of a portable hydration system comprising:
- providing a portable hydration system comprising:
  - a liquid container comprising a liquid outlet;
  - a pump assembly in fluid communication with the liquid container, the pump assembly comprising:
    - a pump; and
    - a fluid inlet in fluid communication with the liquid container and the pump;
  - an electronics package in electrical communication with the pump, the electronics package comprising:
    - a pump power supply in electrical communication with the pump and the electronics package;
- an actuator operable to initiate liquid flow, the actuator comprising:
  - an actuator operable to communicate with the pump via the electronics package;
  - a hose defining a proximal end in fluid communication with the liquid outlet of the liquid container and an oppositely disposed distal end operable to deliver the liquid to a mouth of a user;
- providing a hydration nozzle comprising:
  - a base configured to attach to a helmet comprising:
    - an inlet tube attached to the distal end of the hose;
    - a base sphere formed on the inlet tube; and
    - a liquid path formed between the inlet tube and through the base sphere;
  - a nozzle removably attached to the base sphere, the nozzle comprising:
    - a hollow sphere removably attached to the base sphere;
    - an exit hole formed in the nozzle; and
    - a flow path formed from the hollow sphere to the exit hole;
- pushing the nozzle onto the base sphere whereby the hollow sphere of the nozzle moves relative to the base sphere;

sealing the hollow sphere to the base sphere; and adjusting the hydration spray by moving the nozzle relative to the base.

11. The method of adjusting hydration spray of claim 10 and further comprising:

providing a bezel formed on the nozzle; and wherein the pushing the nozzle onto the sphere occurs at the bezel.

12. The method of adjusting hydration spray of claim 11 wherein the adjusting occurs by exerting force on the bezel.

* * * * *